US010530082B2

(12) United States Patent
Motoyama et al.

(10) Patent No.: US 10,530,082 B2
(45) Date of Patent: Jan. 7, 2020

(54) CIRCUIT BOARD CONNECTOR HAVING A PAIR OF LOCKING ARMS

(71) Applicant: Amphenol FCI Asia Pte Ltd, Singapore (SG)

(72) Inventors: Masahiko Motoyama, Kanagawa (JP); Yasutoshi Kameda, Kisarazu (JP)

(73) Assignee: Amphenol FCI Asia Pte. Ltd., Singapore (SG)

( * ) Notice: Subject to any disclaimer, the term of this patent is extended or adjusted under 35 U.S.C. 154(b) by 0 days.

(21) Appl. No.: 15/755,758

(22) PCT Filed: Aug. 31, 2016

(86) PCT No.: PCT/SG2016/050424
§ 371 (c)(1),
(2) Date: Feb. 27, 2018

(87) PCT Pub. No.: WO2017/039543
PCT Pub. Date: Mar. 9, 2017

(65) Prior Publication Data

US 2019/0027852 A1 Jan. 24, 2019

(30) Foreign Application Priority Data

Aug. 31, 2015 (SG) ..... 10201506887X

(51) Int. Cl.
*H01R 13/627* (2006.01)
*H01R 12/79* (2011.01)
(Continued)

(52) U.S. Cl.
CPC ..... *H01R 12/774* (2013.01); *H01R 12/79* (2013.01); *H01R 13/6275* (2013.01); *H01R 13/639* (2013.01); *H01R 12/775* (2013.01)

(58) Field of Classification Search
CPC ..... H01R 13/627; H01R 12/79
(Continued)

(56) References Cited

U.S. PATENT DOCUMENTS 7,695,311 B2 4/2010 Nemoto
8,002,567 B2 8/2011 Hara
(Continued)

FOREIGN PATENT DOCUMENTS

CN 101242043 A 8/2008
CN 201859994 U 6/2011
(Continued)

OTHER PUBLICATIONS

International Search Report and Written Opinion for International Application No. PCT/SG2016/050424 dated Nov. 29, 2016.
(Continued)

*Primary Examiner* — Abdullah A Riyami
*Assistant Examiner* — Thang H Nguyen
(74) *Attorney, Agent, or Firm* — Wolf, Greenfield & Sacks, P.C.

(57) ABSTRACT

A circuit board connector comprises a housing, at least one signal contact disposed in the housing, and a pair of locking arms attached to the housing. The housing has a slot formed therein, for receiving a circuit board. Each locking arm has a latch movably disposed in the slot. The pair of locking arms are resiliently deformable relative to the housing between a lock position at which the latch is positioned to block the slot, to lock a circuit board to the connect, and an unlock position at which the latch is positioned to form a clearance in the slot, to allow disconnection of the circuit board from the connector.

20 Claims, 25 Drawing Sheets

(51) Int. Cl.
*H01R 12/77* (2011.01)
*H01R 13/639* (2006.01)

(58) Field of Classification Search
USPC ..... 439/350, 329, 260, 495
See application file for complete search history.

(56) References Cited

U.S. PATENT DOCUMENTS

| | | | | |
|---|---|---|---|---|
| 8,221,147 | B2 * | 7/2012 | Ozeki | H01R 12/88 439/260 |
| 8,303,326 | B1 * | 11/2012 | McKee | H01R 13/6275 439/358 |
| 8,371,880 | B2 * | 2/2013 | Ishimaru | H01R 12/61 439/632 |
| 8,376,762 | B2 | 2/2013 | Ozeki | |
| 8,398,417 | B2 * | 3/2013 | Ozeki | H01R 12/774 439/260 |
| 8,444,427 | B2 | 5/2013 | Hashimoto | |
| 8,512,058 | B2 | 8/2013 | Ozeki | |
| 8,651,885 | B2 | 2/2014 | Ashibu | |
| 8,678,844 | B2 * | 3/2014 | Yoshisuji | H01R 12/592 439/260 |
| 8,747,133 | B2 | 6/2014 | Shen et al. | |
| 8,851,918 | B2 * | 10/2014 | Yoshisuji | H01R 13/639 439/260 |
| 8,968,020 | B2 | 3/2015 | Nishiyama | |
| 9,054,451 | B2 | 6/2015 | Tateishi et al. | |
| 9,065,210 | B2 | 6/2015 | Narita | |
| 9,088,115 | B2 * | 7/2015 | Komoto | H01R 12/774 |
| 9,153,888 | B2 | 10/2015 | Kajiura et al. | |
| 9,466,903 | B2 | 10/2016 | Kajiura et al. | |
| 9,640,884 | B2 | 5/2017 | Sasame et al. | |
| 10,164,364 | B2 * | 12/2018 | Asanuma | H01R 12/774 |
| 10,305,209 | B2 | 5/2019 | Ishishita | |
| 2005/0003696 | A1 * | 1/2005 | Shirk | H01R 13/627 439/352 |
| 2008/0050966 | A1 | 2/2008 | Hashiguchi et al. | |
| 2010/0261369 | A1 | 10/2010 | Satoh | |
| 2010/0304591 | A1 | 12/2010 | Ishishita et al. | |
| 2011/0136365 | A1 * | 6/2011 | Hara | H01R 12/79 439/329 |
| 2012/0220171 | A1 * | 8/2012 | Shimada | H01R 12/774 439/660 |
| 2012/0329300 | A1 * | 12/2012 | Ikari | H01R 12/7029 439/153 |
| 2014/0073166 | A1 | 3/2014 | Kim et al. | |
| 2015/0171536 | A1 * | 6/2015 | Kameda | H01R 12/772 439/329 |
| 2015/0311620 | A1 | 10/2015 | Tateishi et al. | |
| 2016/0099511 | A1 | 4/2016 | Ozeki | |
| 2016/0336668 | A1 | 11/2016 | Kim et al. | |
| 2017/0250483 | A1 | 8/2017 | Ishishita | |

FOREIGN PATENT DOCUMENTS

| | | | |
|---|---|---|---|
| CN | 102142631 | A | 8/2011 |
| CN | 102651519 | A | 8/2012 |
| CN | 102842811 | A | 12/2012 |
| CN | 202601982 | U | 12/2012 |
| CN | 103390810 | A | 11/2013 |
| CN | 103633471 | A | 3/2014 |
| CN | 104051904 | A | 9/2014 |
| CN | 204885665 | U | 12/2015 |
| EP | 2 251 937 | A1 | 11/2010 |
| EP | 2330688 | A1 | 6/2011 |
| EP | 2 469 665 | A2 | 6/2012 |
| EP | 2493023 | A2 | 8/2012 |
| EP | 2 568 538 | A1 | 3/2013 |
| JP | 4353436 | B2 | 10/2009 |
| JP | 2011-119162 | A | 6/2011 |
| JP | 2012-109059 | A | 6/2012 |
| JP | 2012-174522 | A | 9/2012 |
| JP | 2014-179300 | A | 9/2014 |
| JP | 2015-026447 | A | 2/2015 |
| SG | 2016/050424 | A | 11/2016 |
| SG | 2016/050424 | A | 3/2018 |
| WO | WO 2012/008353 | A1 | 1/2012 |

OTHER PUBLICATIONS

International Preliminary Report on Patentability for International Application No. PCT/SG2016/050424 dated Mar. 15, 2018.

Extended European Search Report for European Application No. 16842435.6 dated Mar. 19, 2019.

Chinese Office Action for Application No. CN 201680063215.5 dated Mar. 12, 2019.

* cited by examiner

C-C

D-D

E-E

F-F

G-G

H-H

I-I

I-I

J-J

K-K

L-L

CIRCUIT BOARD CONNECTOR HAVING A PAIR OF LOCKING ARMS

CROSS-REFERENCE TO RELATED APPLICATIONS

This application is the U.S. National Stage of and claims priority to and the benefit of International Patent Application Number PCT/SG2016/050424, entitled "CIRCUIT BOARD CONNECTOR" filed on Aug. 31, 2016, which claims priority under 35 U.S.C. § 119(e) to the Republic of Singapore application 10201506887X, entitled "CIRCUIT BOARD CONNECTOR" filed on Aug. 31, 2015. The entire contents of these applications are incorporated herein by reference in their entirety.

FIELD OF THE INVENTION

The present invention relates to an electrical connector, and particularly relates to a circuit board connector.

BACKGROUND

Electrical connectors such as circuit board connectors are widely used in electronic devices and systems. To improve the electrical connectivity, there is often a requirement to secure a circuit board to the circuit board connector. Therefore, there is a need to ensure secure and reliable connection between the circuit board and the circuit board connector.

SUMMARY

Embodiments of the present invention provides a circuit board connector which comprises a housing, at least one signal contact disposed in the housing, and a pair of locking arms attached to the housing. The housing has a slot formed therein, for receiving a circuit board. Each locking arm has a latch movably disposed in the slot. The pair of locking arms are resiliently deformable relative to the housing between a lock position at which the latch is positioned to block the slot, to lock a circuit board to the connector, and an unlock position at which the latch is positioned to form a clearance in the slot, to allow disconnection of the circuit board from the connector.

Other characteristics will become apparent from the subsequent detailed description and the appended claims, taken in conjunction with the accompanying drawings.

BRIEF DESCRIPTION OF DRAWINGS

The accompanying figures, where like reference numerals refer to same or functionally similar elements throughout the separate views and which together with the detailed description below are incorporated in and form part of the specification, serve to illustrate various embodiments and to explain various principles and advantages in accordance with the embodiments.

DETAILED DESCRIPTION

Figure 1:
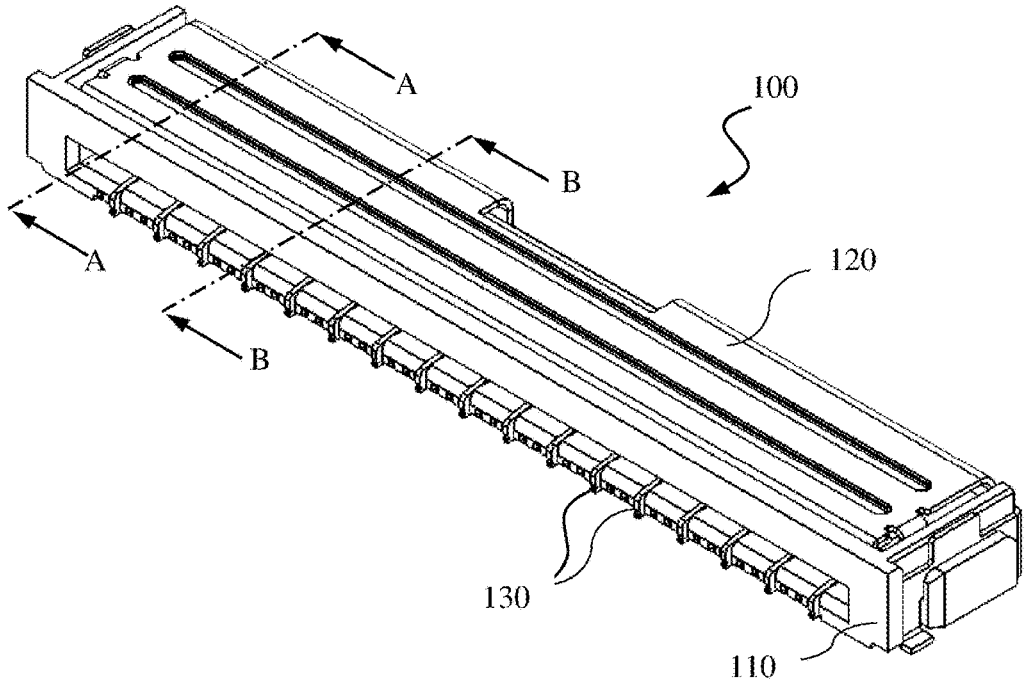
FIG. 1 is a perspective view of a circuit board connector in accordance with one embodiment of the present invention.
Figure 2:
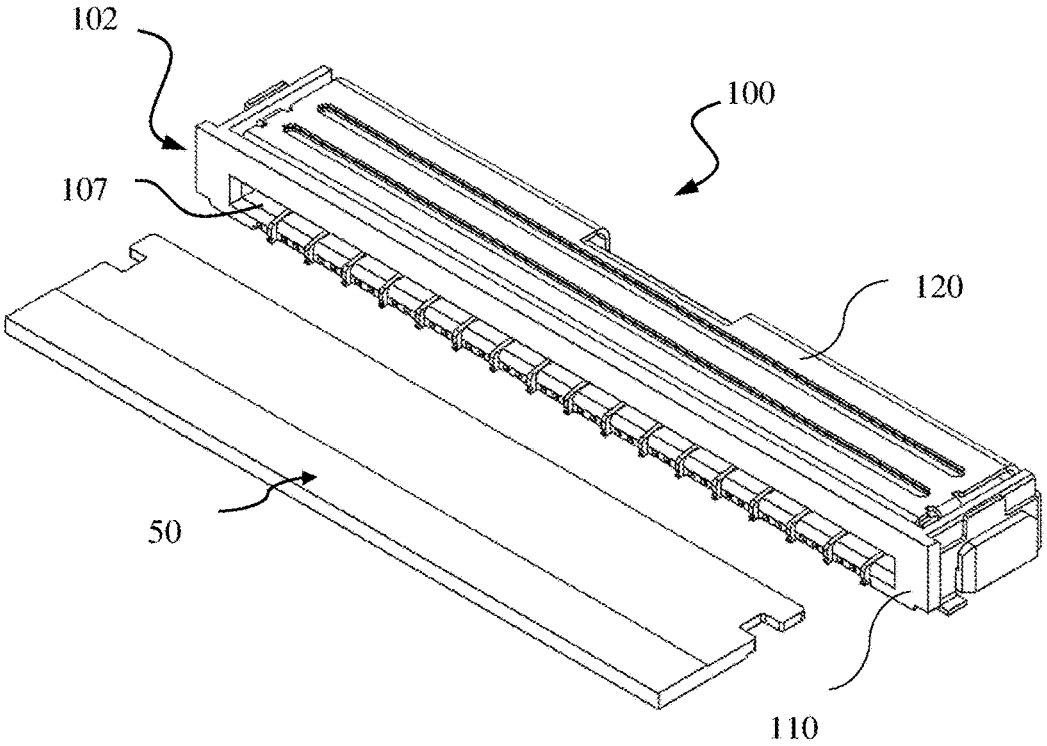
FIG. 2 is a perspective view of the circuit board connector as depicted in FIG. 1 and a circuit board to be connected to the circuit board connector.

Referring to FIGS. 1, 2, 3, 4A and 4B, a circuit board connector 100 comprises a housing 110, at least one signal contact 129 disposed in the housing 110, and a pair of locking arms 122A and 122B attached to the housing 110. Housing 110 has a slot 107 opening to a front side 102 of housing 110. Slot 107 is to receive a circuit board 50 into housing 110, to establish electrical connection between circuit board 50 and the at least one signal contact 129 of circuit board connector 100. Locking arm 122A, 122B each has a latch 124A, 124B formed thereon. The pair of locking arms 122A, 122B are resiliently deformable relative to the housing 110 between a lock position and an unlock position. At the lock position, shown in FIG. 4B in solid lines, latch 124A is positioned in slot 107 and blocks the full height 107 A of slot 107. At the unlock position, shown in FIG. 4B in dashed lines, the latch 124A' is positioned to partially blocking the slot 107. i.e. forming a clearance 107B at the height direction of slot 107.

Figure 4A:
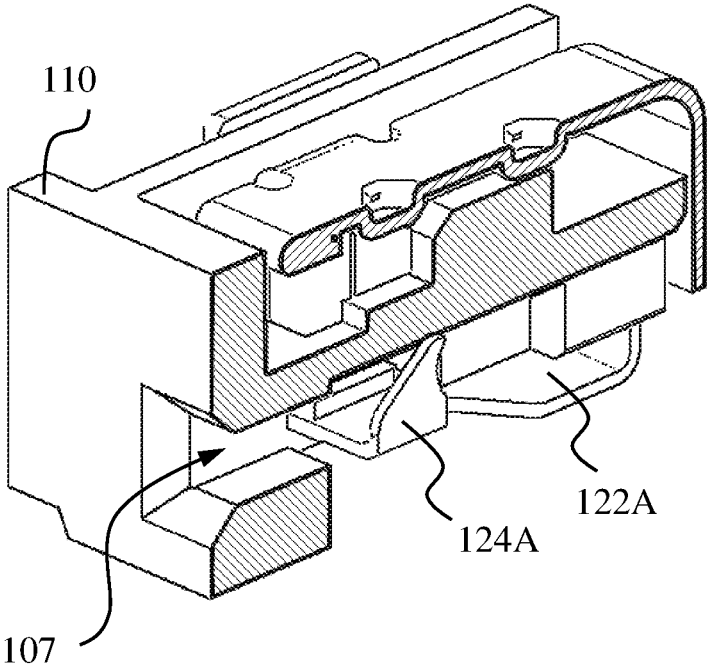
FIG. 4A is a cross sectional perspective view of FIG. 1 along A-A.
Figure 4B:
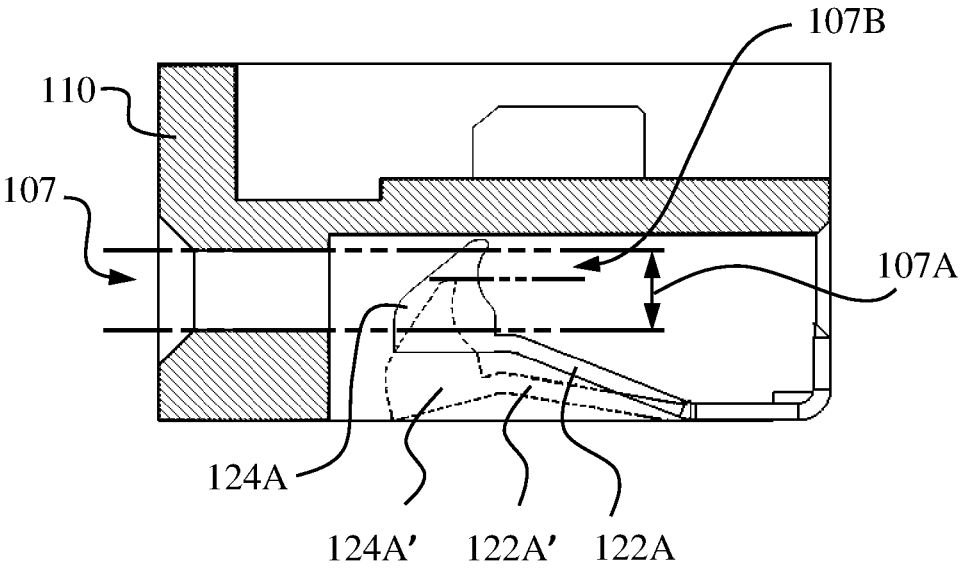
FIG. 4B is a side view of FIG. 4A.
Figure 4C:
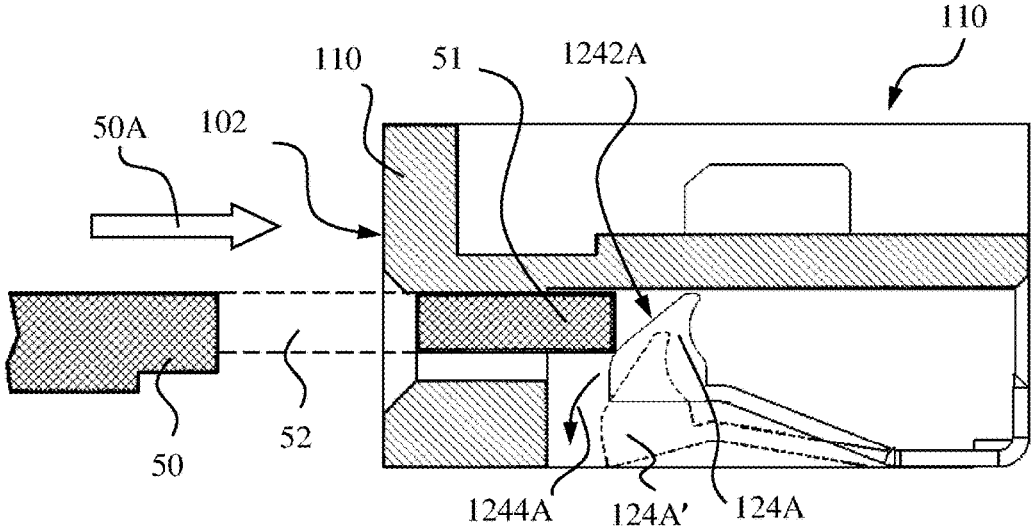
FIG. 4C is a side view of FIG. 4A together with a circuit board to be connected to the circuit board connector.
Figure 4D:
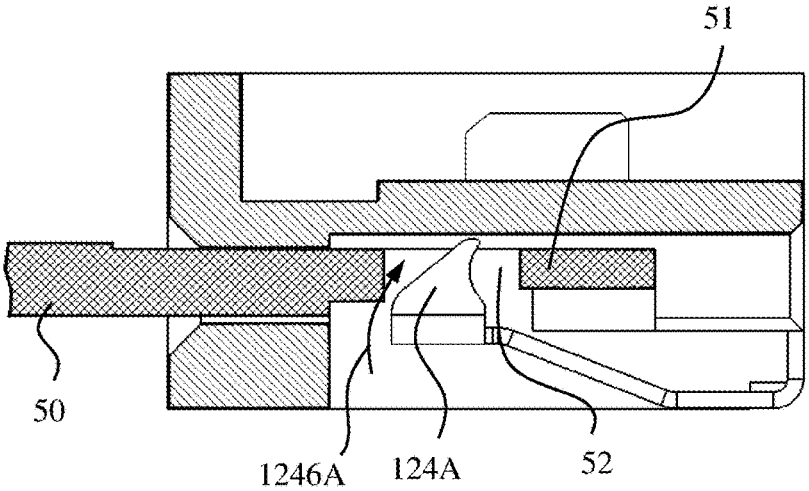
FIG. 4D is a side view of FIG. 4A with the circuit board connected to the circuit board connector.

As shown in FIG. 4C, each latch 124A, 124B (only latch 124A is shown in FIG. 4C) has an inclined surface 1242A facing front side 102 of housing 110. A circuit board 50 is to be inserted into slot 107 from a front side 102 of the housing 110, for connecting to circuit board connector 100. Circuit board 50 has two openings or notches 52, 54 formed at the lateral sides, and a retaining portion 51 at front end thereof. During the process of circuit board 50 insertion into slot 107, along insertion direction 50A, the retaining portion 51 abuts against the inclined surface 1242A of latch 124A, causing the latch 124A to displace downwardly from the lock position to the unlock position, along deflection direction 1244A. After the retaining portion 51 passes over the inclined surface 1242A, as shown in FIG. 4D, latch 124A is positioned in alignment with notch 52 and is allowed to return from the unlock position to the lock position, along returning direction 1246A. At the lock position, latch 124A blocks the clearance 107B of slot 107 to engage with the retaining portion 51 of circuit board 50, to prevent the circuit board 50 from being removed out of the slot 107. Latch 124B and locking arm 122B have the same, symmetrical structure and operations in a same manner as latch 124A and locking arm 122A.

Figure 3:
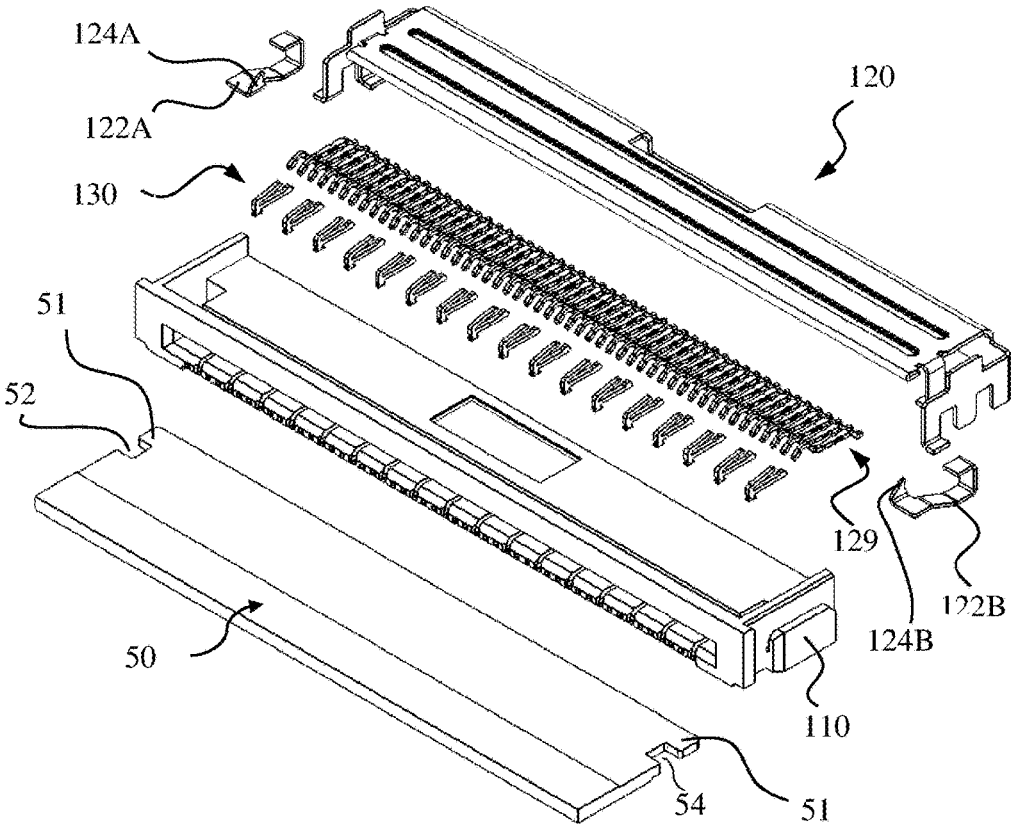
FIG. 3 is an exploded perspective view of FIG. 2.
Figure 4E:
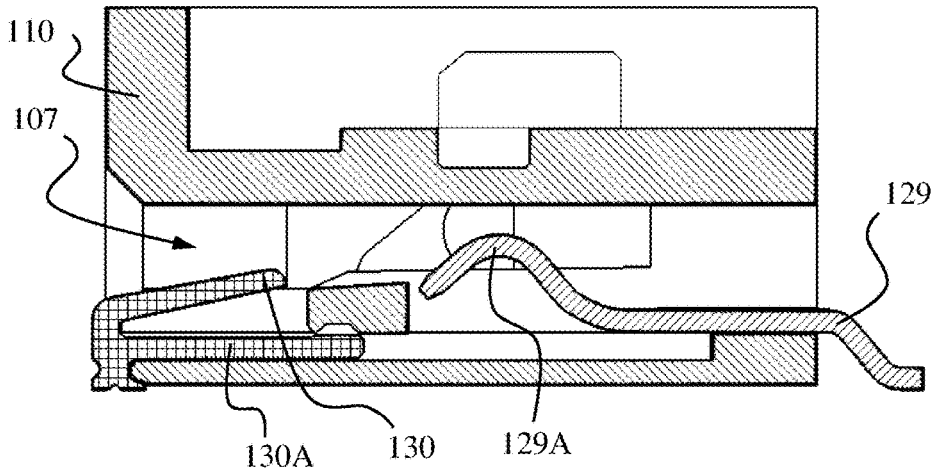
FIG. 4E is a cross section side view of FIG. 1 along B-B.
Figure 5:
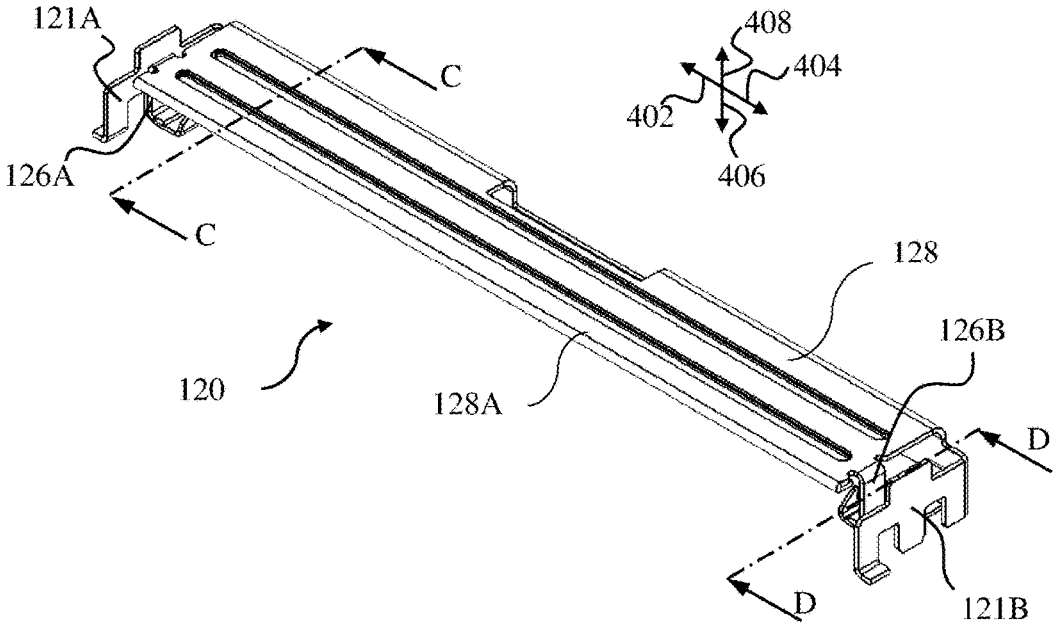
FIG. 5 is a perspective view showing a pair of locking arms and an actuating member of the circuit board connector as depicted in FIG. 1.
Figure 6A:
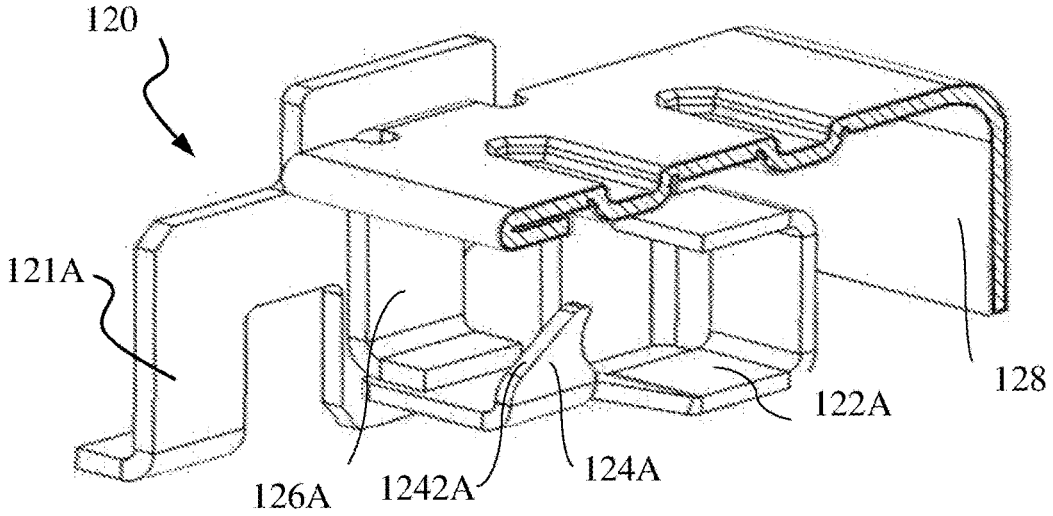
FIG. 6A is a cross sectional perspective view of FIG. 5 along C-C.
Figure 6B:
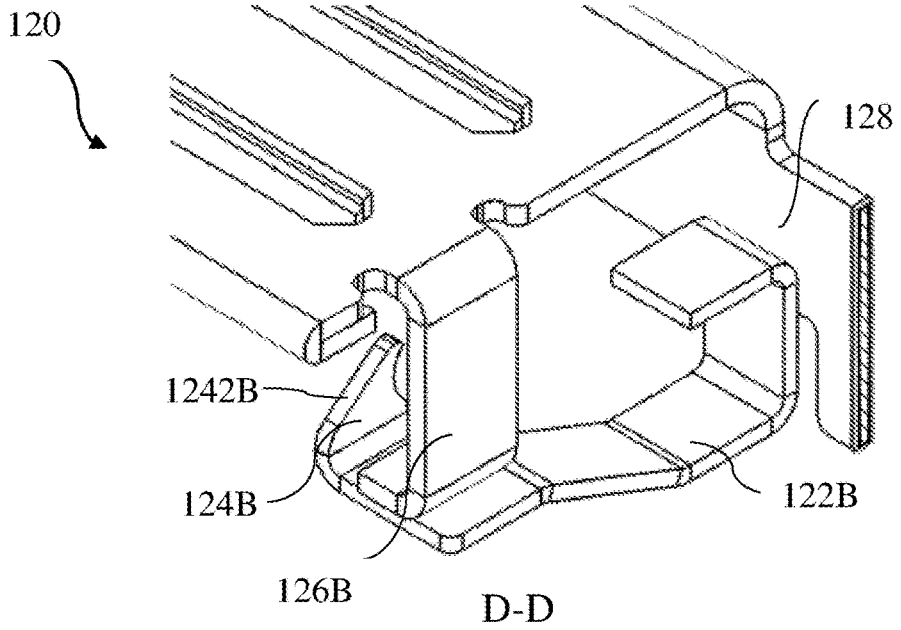
FIG. 6B is a partial cross section view of the actuating member as depicted in FIG. 5 along D-D.
Figure 7:
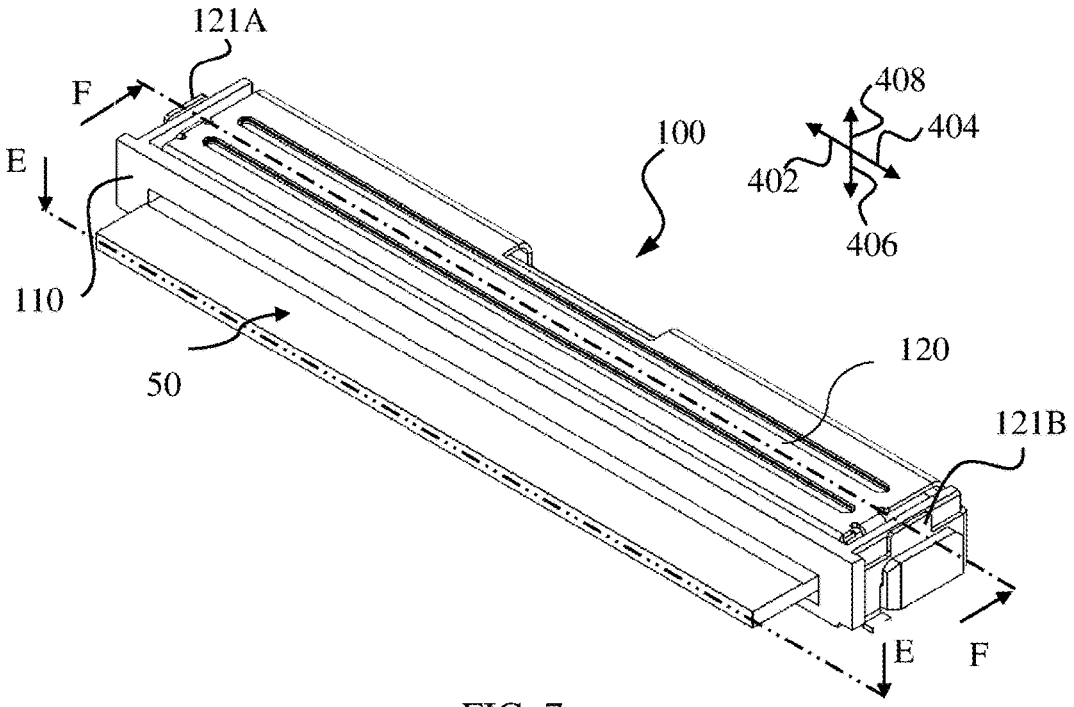
FIG. 7 is a perspective view of the circuit board connector show in FIG. 1 and a circuit board connected to the circuit board connector.
Figure 8:
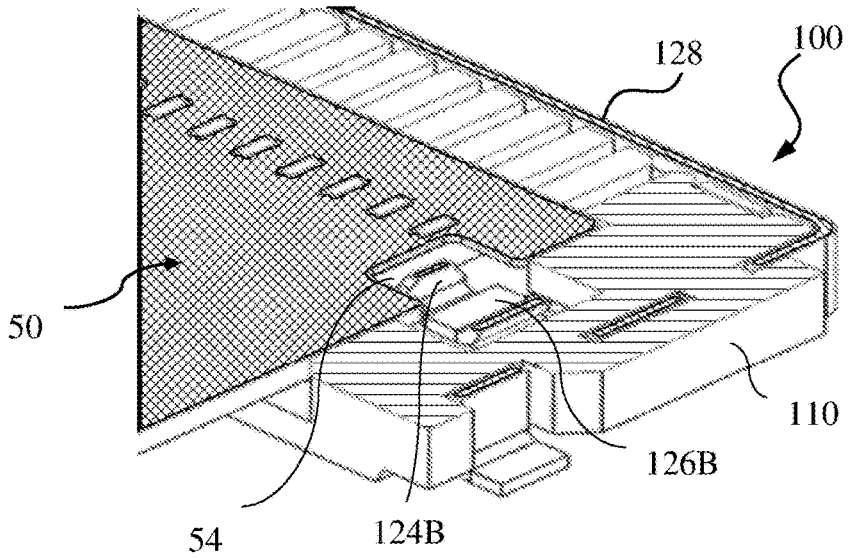
FIG. 8 is an enlarged partial cross section view of the circuit board connector as 5 depicted in FIG. 7 along E-E.
Figure 9:
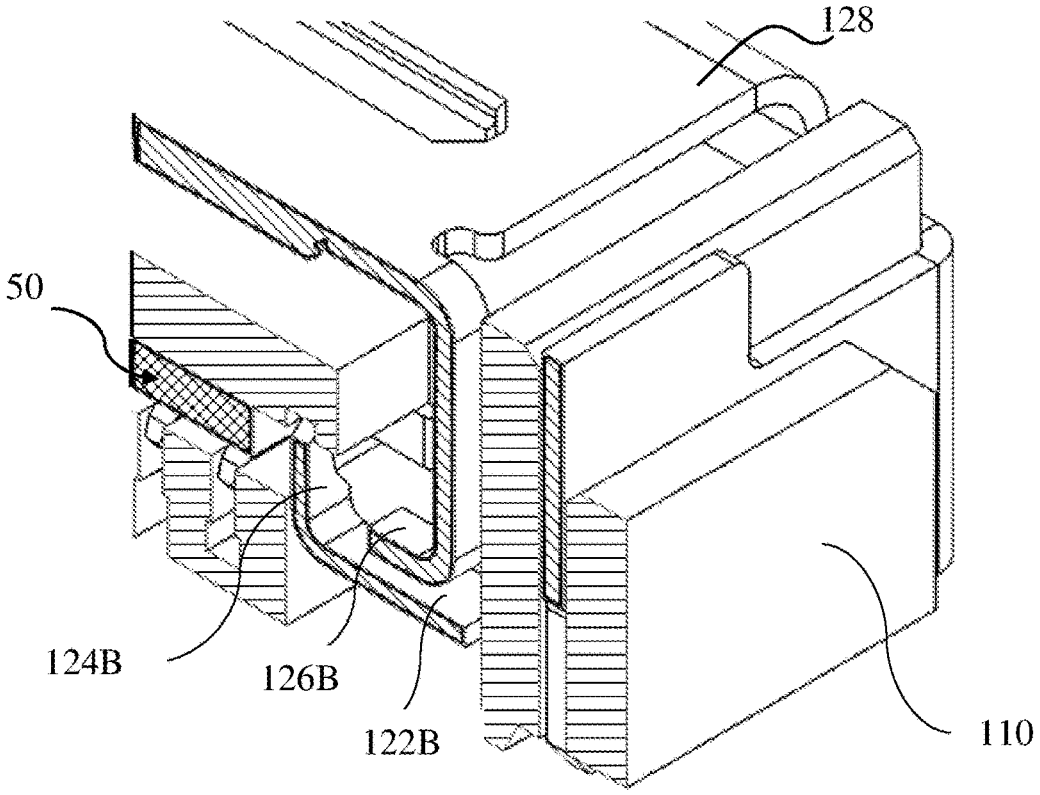
FIG. 9 is an enlarged partial cross section view of the circuit board connector as depicted in FIG. 7 along line F-F.

As shown in FIGS. 3 and 4E, circuit board connector 100 may include at least one ground terminal 130 attached to housing 110. Ground terminal 130 has a contact portion 130A which is disposed at the same side of slot 107 as contact portion 129A of signal contact 129.

Circuit board connector 100 may further include an actuating member 120 coupled to housing 110. In some embodiments, actuating member 120 is comprised of metal and serves a shielding function. Actuating member 120 has a pair of actuating arms 126A. 126B positioned adjacent to a respective one of the locking arms 122A, 122B. As shown in FIGS. 5, 6A, 6B, 7, 8 and 9, locking arms 122A and 122B are attached to housing 110 and disposed adjacent to and in the downward direction 406 of the actuating arm 126A and 126B, respectively, such that movement in the downward direction 406 of the actuating arms 126A and 126B can respectively drive locking arms 122A and 122B to deflect in the downward direction 406 from an original (lock) position to an unlock position. Each of the locking arms 122A and 122B has a latch 124A and 124B projected in an upward direction 408, respectively. The latch 124A. 124B of each locking arm 122A, 122B are allowed to remain at the lock position when the pair of actuating arms 126A, 126B are at the original position. During an insertion process of circuit board 50 into the slot 107, circuit board 50 causes the latches 124A. 124B to deflect to form the clearance 107B, to allow the circuit board 50 to be placed in the slot 107 to establish electrical connection with circuit board connector 100. When the circuit board 50 is fully inserted into the slot 107, the latches 124A, 124B resumes to the lock position to block the clearance 107B and engages the retaining portion 51 of circuit board 50.

When it is desired to disconnect circuit board 50 from circuit board connector 100, the pair of actuating arms 126A, 126B are deformed from the original position to the deflected position, upon receiving an external force, to bias against the pair of locking arms 122A, 122B which in turn move the latches 124A. 124B to the unlock position to release the engagement with the retaining portion 51 of the circuit board 50. Circuit board 50 can then be removed from slot 107 and disconnected from circuit board connector 100.

Actuating member 120 has a beam 128 connecting the pair of actuating arms 126A and 126B there between. The beam 128 is to receive an external force to displace the pair of actuating arms 126A, 126B from the original position to the deflected position.

Actuating member 120 may have a pair of side plates 121A, 121B connected to the beam 128. The pair of side plates 121A, 121B are fixedly attached to the housing 110. The beam 128 and the pair of actuating arms 126A, 126B are resiliently deformable relative to the pair of side plates 121A. 121B.

Figure 10A:
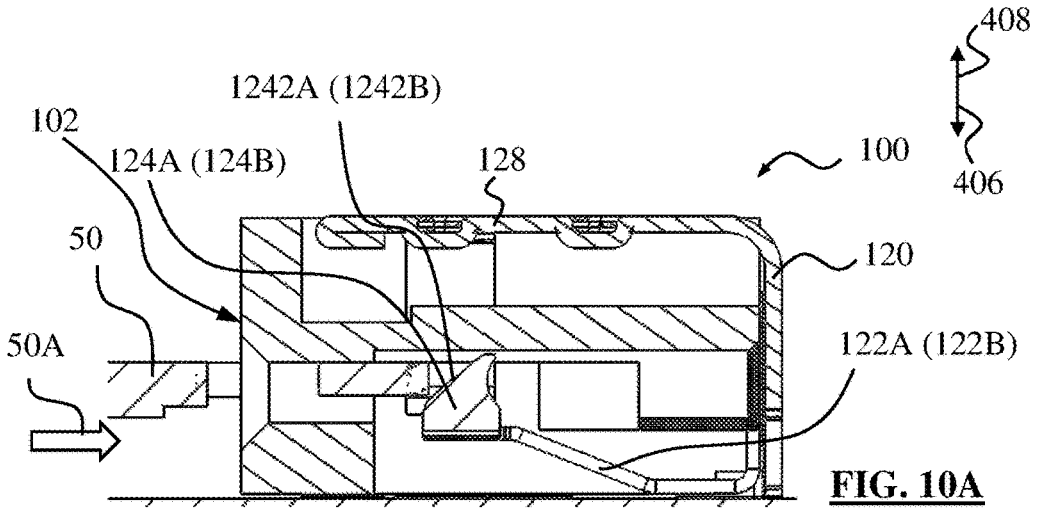
FIGS. 10A, 10B and 10C are cross sectional side views of FIG. 1 along A-A depicting a process of connecting a circuit board to the circuit board connector as depicted in FIG. 1.
Figure 10B:
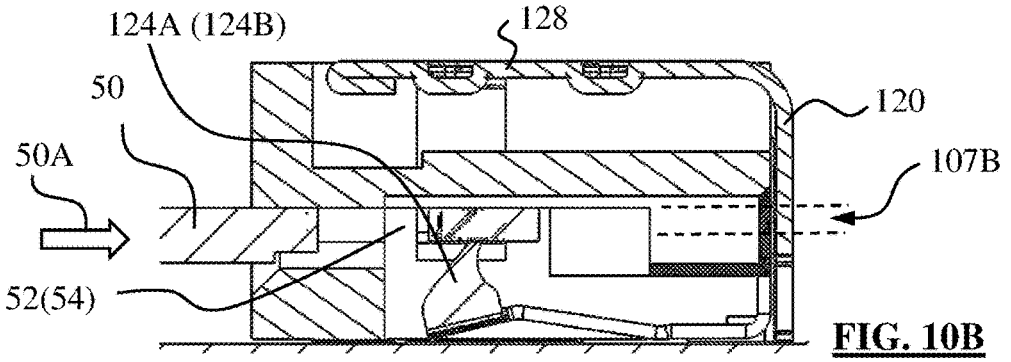
Figure 10C:
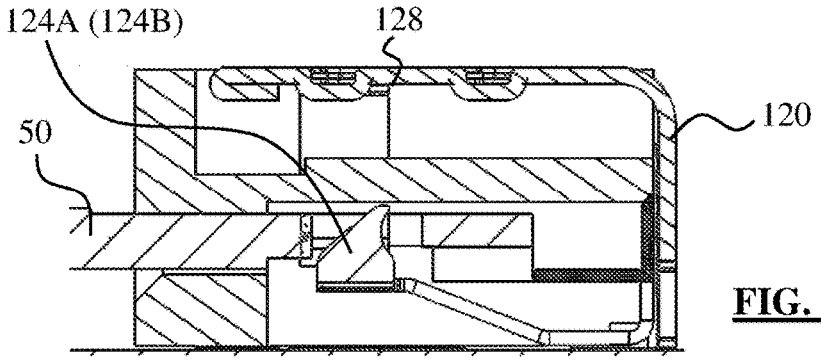

The process of connecting a circuit board 50 into the circuit board connector 100 is further illustrated in conjunction with FIGS. 10A, 10B and 10C. The circuit board 50 is to be inserted, along direction 50A, into circuit board connector 100 from front side 102. The circuit board 50 is then brought into contact with inclined surface 1242A and 1242B of the latch 124A and 124B which is positioned in front of the insertion path as seen in FIG. 10A. Advancement of circuit board 50 along direction 50A exerts a pressure on the inclined surface 1242A and 1242B of the latches 124A and 124B, by which, the locking arms 122A and 122B are biased to deflect in the downward direction 406 from the lock position, as seen in FIG. 10A, to the unlocked position, as seen in FIG. 10B where the latch 124A is deflected away from the insertion path to form a clearance 107B, to allow the circuit board 50 to pass over. As the circuit board 50 is further inserted, the openings 52 and 54 will be in alignment with the latches 124A, 124B, respectively, allowing latches 124A, 124B to return to the original (lock) position, thereby locking the circuit board 50 to the electrical connector 100. Electrical connections between the circuit board and the circuit board connector is established and maintained.

Figure 11A:
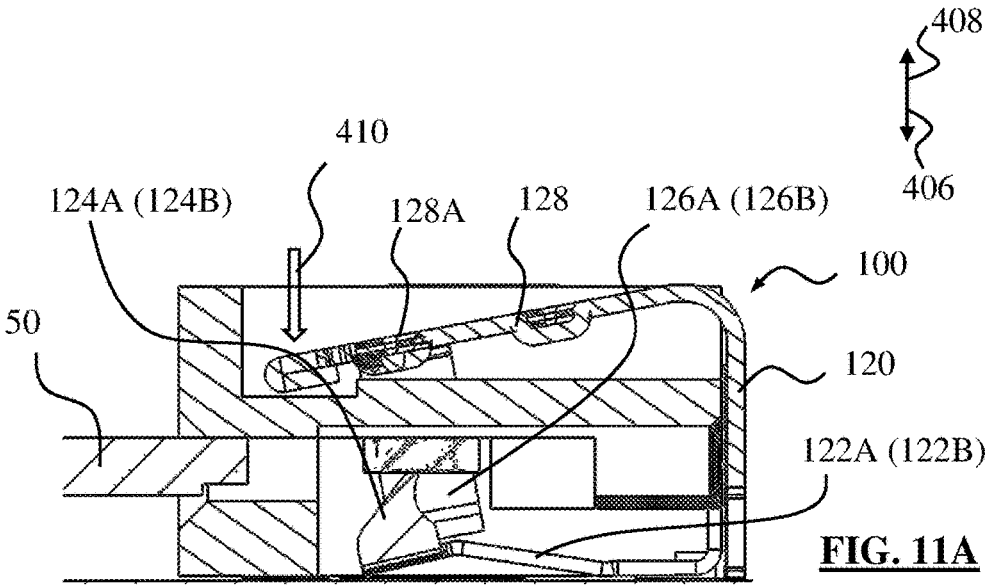
FIGS. 11A, 11B and 11C are cross sectional side views of FIG. 1 along A-A depicting a process of disconnecting a circuit board from the circuit board connector as depicted in FIG. 1.
Figure 11B:
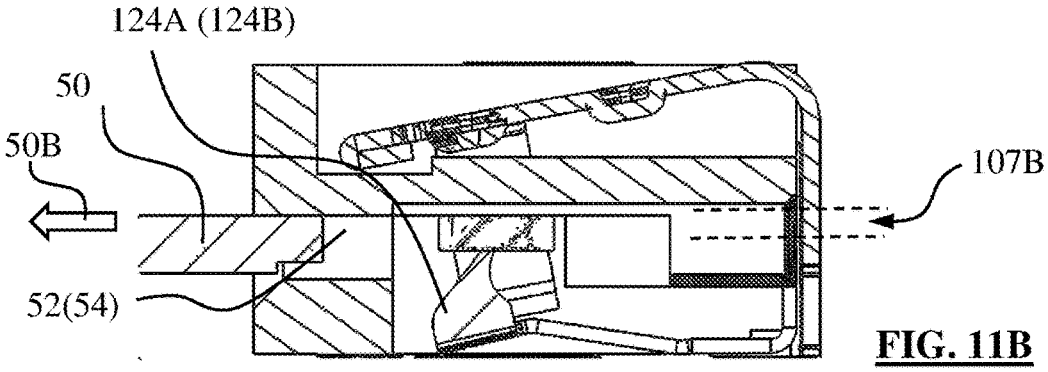
Figure 11C:
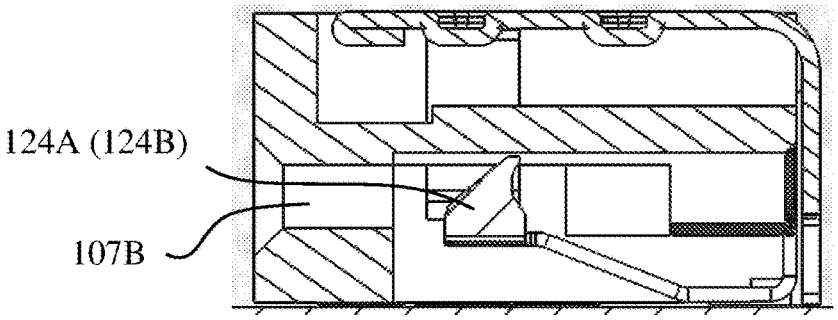
Figure 12:
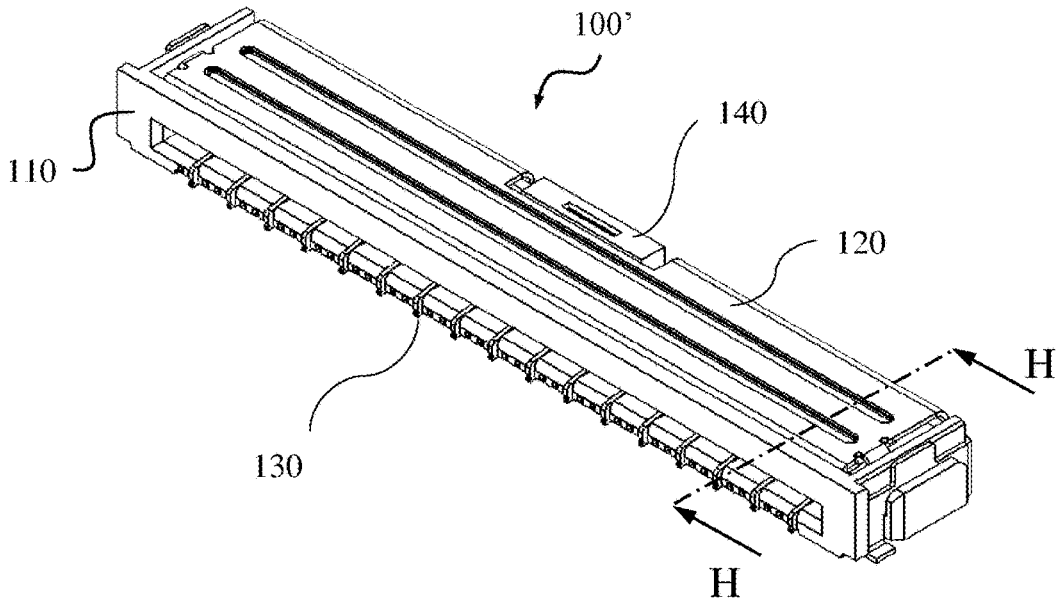
FIG. 12 is a perspective view of a circuit board connector according to another embodiment of the present invention.
Figure 13:
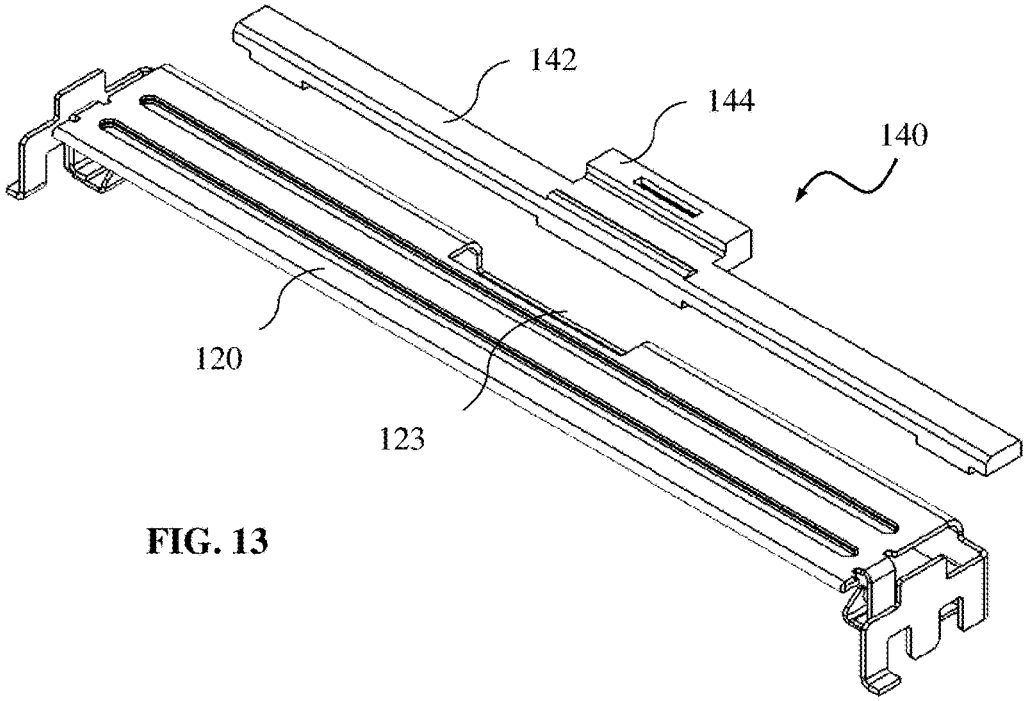
FIG. 13 is a perspective view showing an actuating member and a stopper of the circuit board connector shown in FIG. 12.
Figure 14:
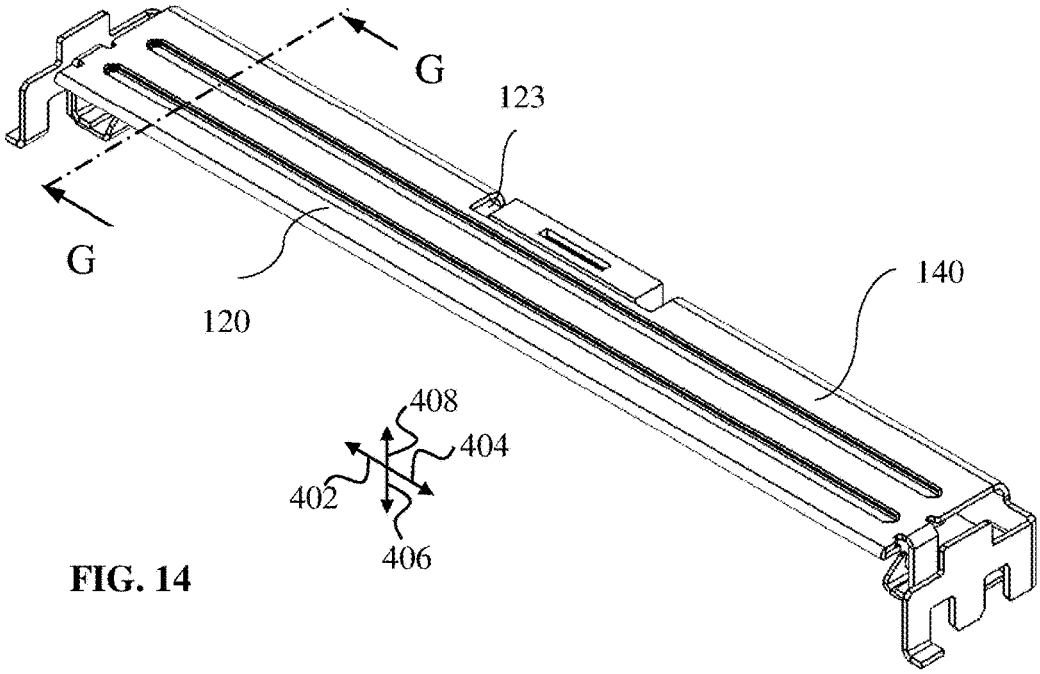
FIG. 14 is a perspective view showing the actuating member and the stopper engaged to the actuating member.
Figure 15:
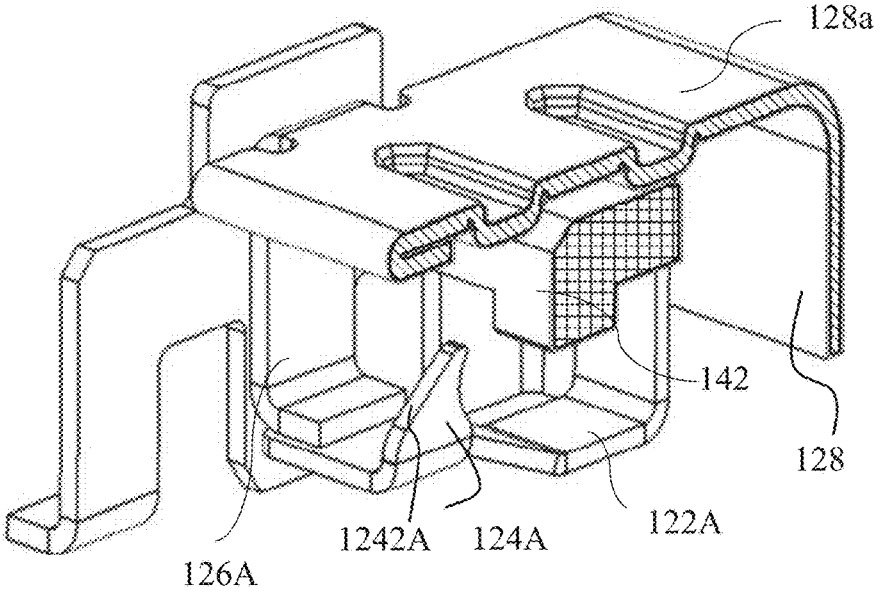
FIG. 15 is a cross section view of the actuating member as depicted in FIG. 14 along G-G.
Figure 16:
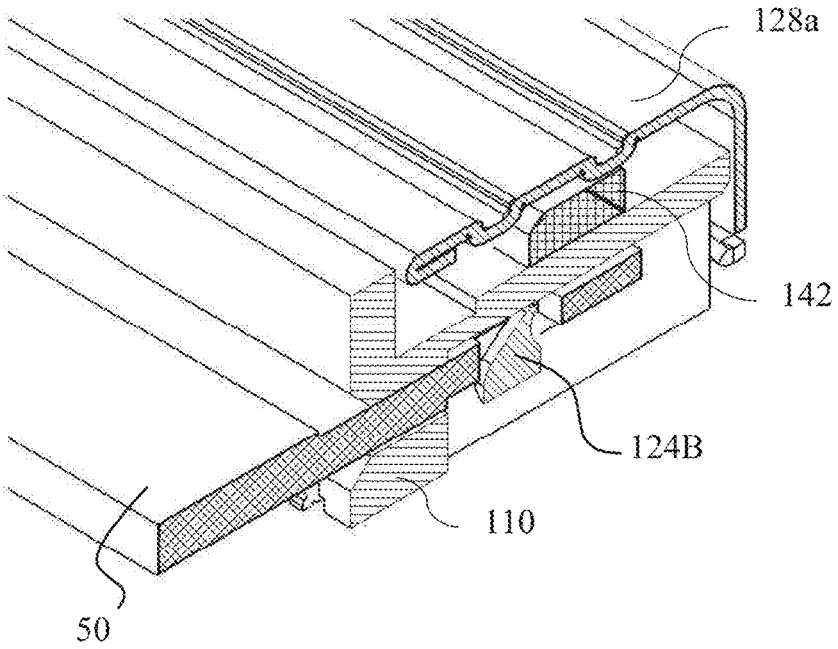
FIG. 16 is a partial cross section view of the circuit board connector as depicted in FIG. 12 along H-H.

FIGS. 11A, 11B and 11C show a disconnecting process of circuit board 50 from circuit board connector 100. Firstly, beam 128 of the actuating member 120 is pressed in the downward direction 406 by an external force 410, which simultaneously moves the actuating arms 126A and 126B in the downward direction 406, and the actuating arm 126A in turn drives the locking arms 122A, 122B to deflect in the downward direction 406, causing the latches 124A and 122B to move out of the openings 52, 54 of the circuit board 50 and form the clearance 107B in slot 107 to the unlocked position, as shown in FIG. 11B. The circuit board 50 is then able to be removed from the circuit board connector 100.

In accordance with another embodiment, as shown in FIGS. 12 to 16, an electrical connector 100' includes a stopper 140 which is movably attached to housing 110. Stopper 140 has a mid portion 144 and a pair of side portions 142 laterally connected to the mid portion 142.

Stopper 140 is movably attached to housing 110. Upon positioned in a space between the housing 110 and the beam 128, the stopper 140 prevents the pair of actuating arms 126A, 126B from deflecting from the lock position to the unlock position. After the stopper 140 is removed from the space, the pair of actuating arms 126A, 126B is allowed to deflect from the lock position to the unlock position.

Figure 17A:
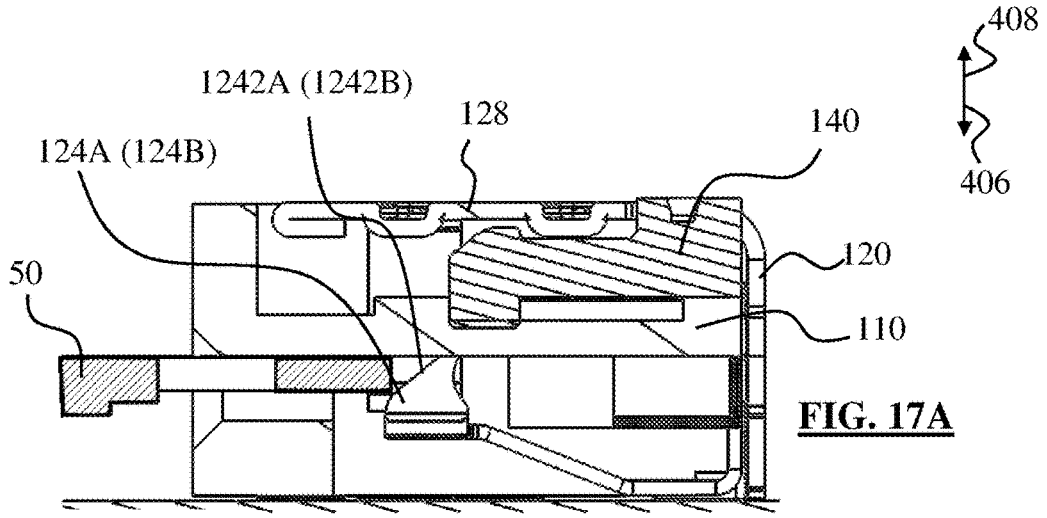
FIGS. 17A, 17B and 17C are cross sectional side views of FIG. 12 along H-H depicting a process of connecting a circuit board to the circuit board connector as depicted in FIG. 12.
Figure 17B:
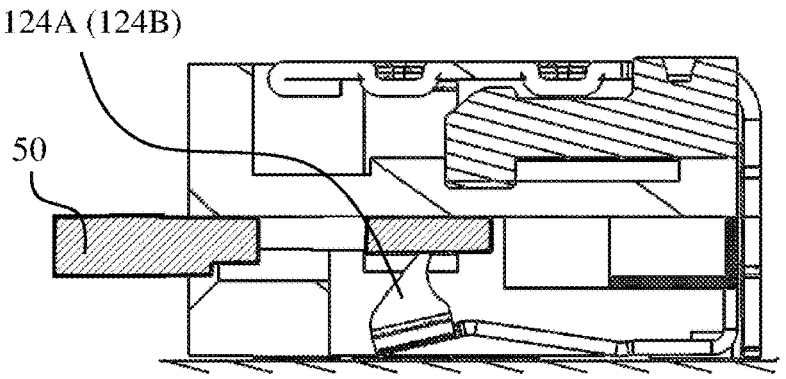
Figure 17C:
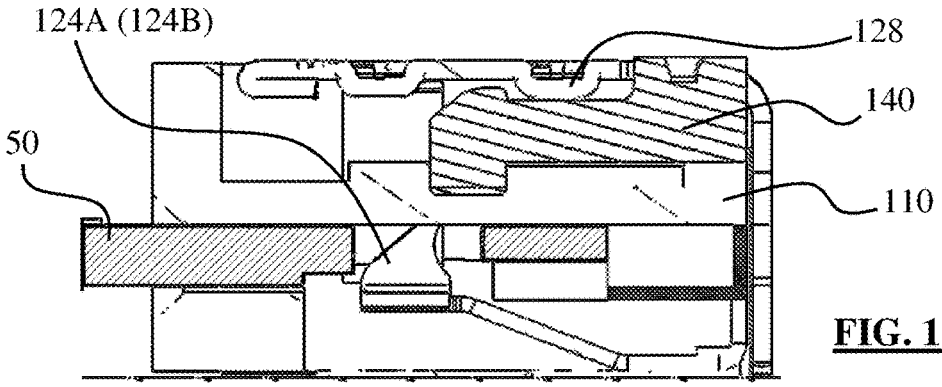
Figure 18A:
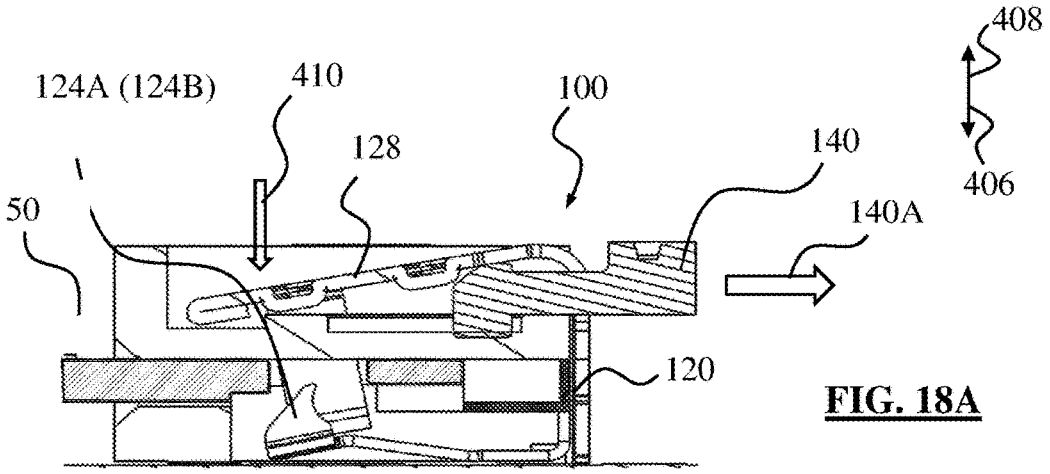
FIGS. 18A, 18B, 18C and 18D are cross sectional side views of FIG. 12 along H-H depicting a process of disconnecting a circuit board from the circuit board connector as depicted in FIG. 12.
Figure 18B:
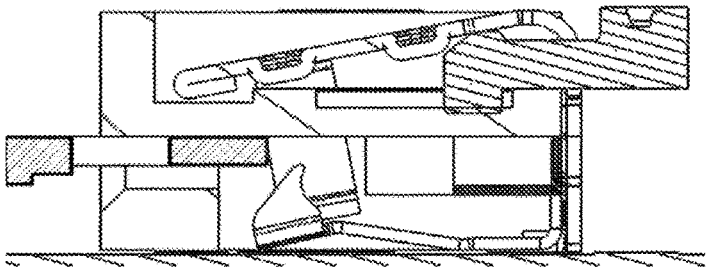
Figure 18C:
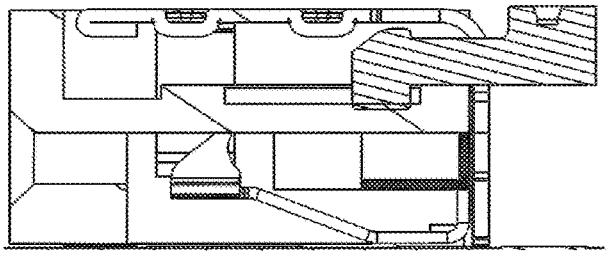
Figure 18D:
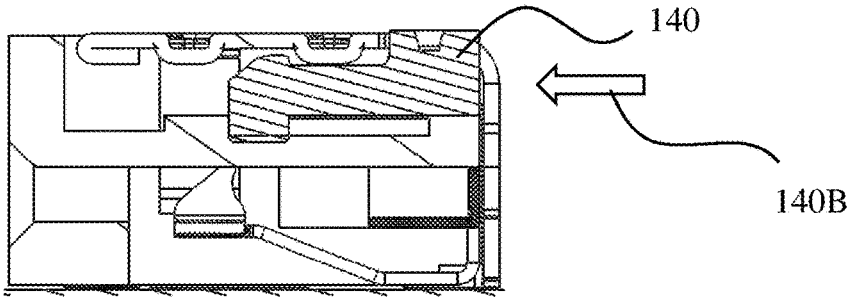
Figure 19:
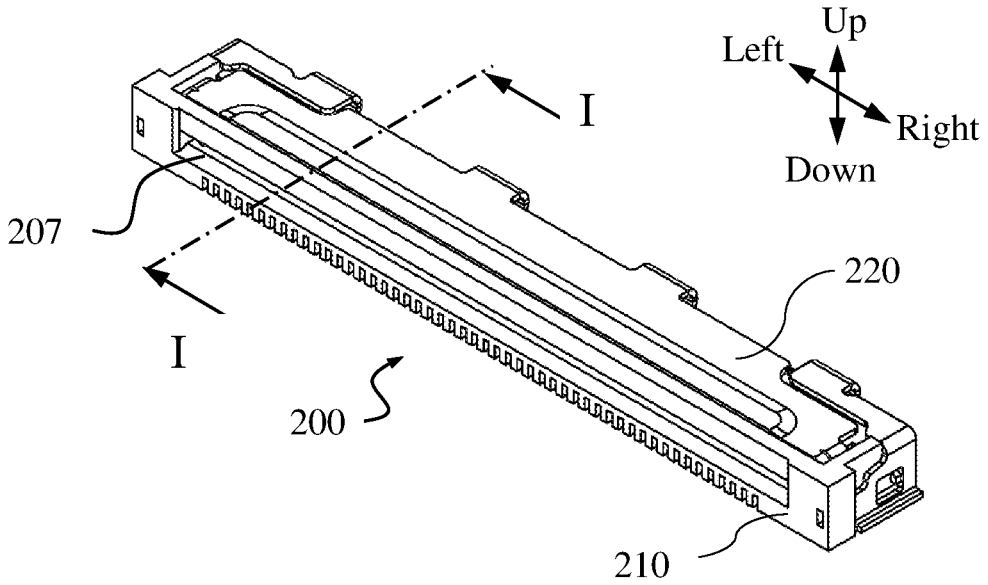
FIG. 19 is a perspective view of a circuit board connector according to yet another embodiment of the present invention.
Figure 20:
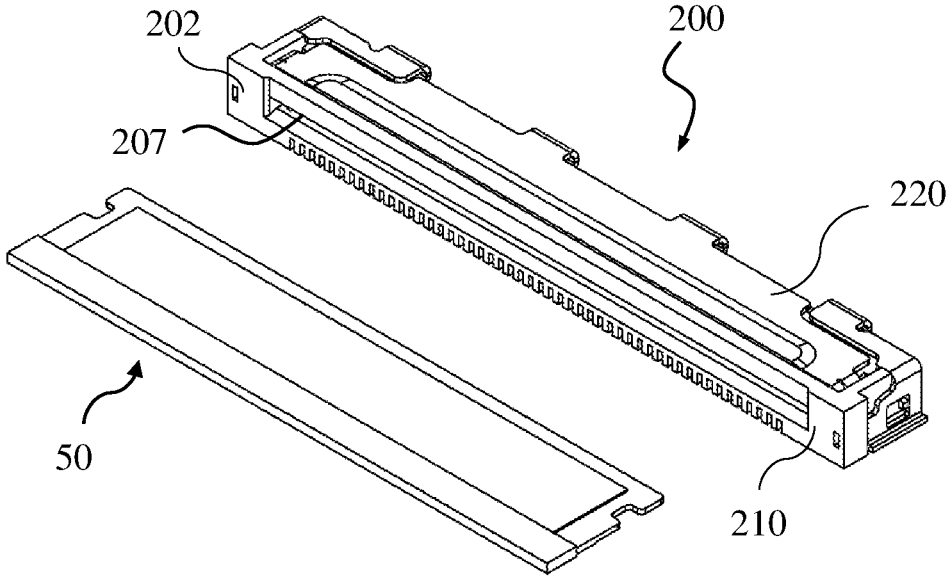
FIG. 20 is a perspective view of the circuit board connector as depicted in FIG. 19 and a circuit board to be connected to the circuit board connector.
Figure 21:
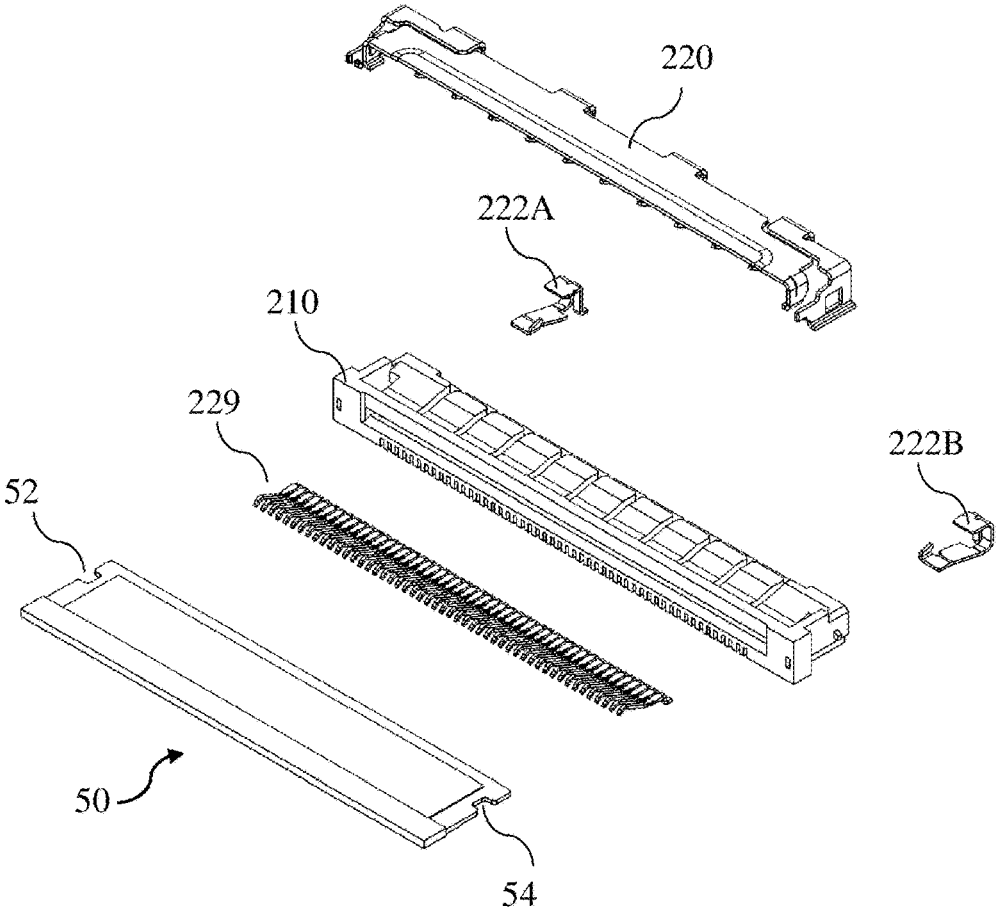
FIG. 21 is an exploded perspective view of FIG. 20.
Figure 22A:
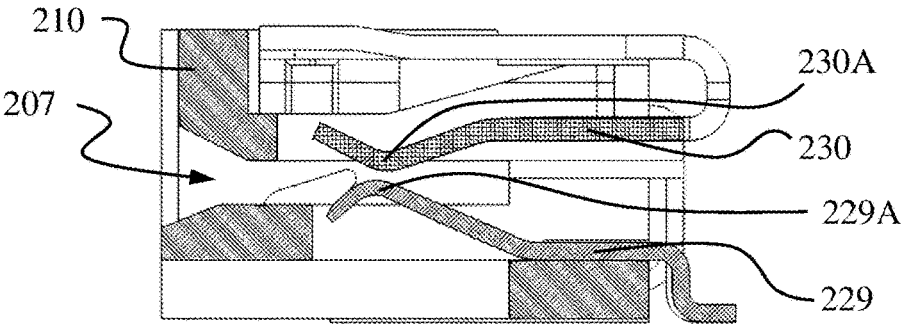
FIG. 22A is a cross sectional side view of FIG. 19 along I-I.
Figure 22B:
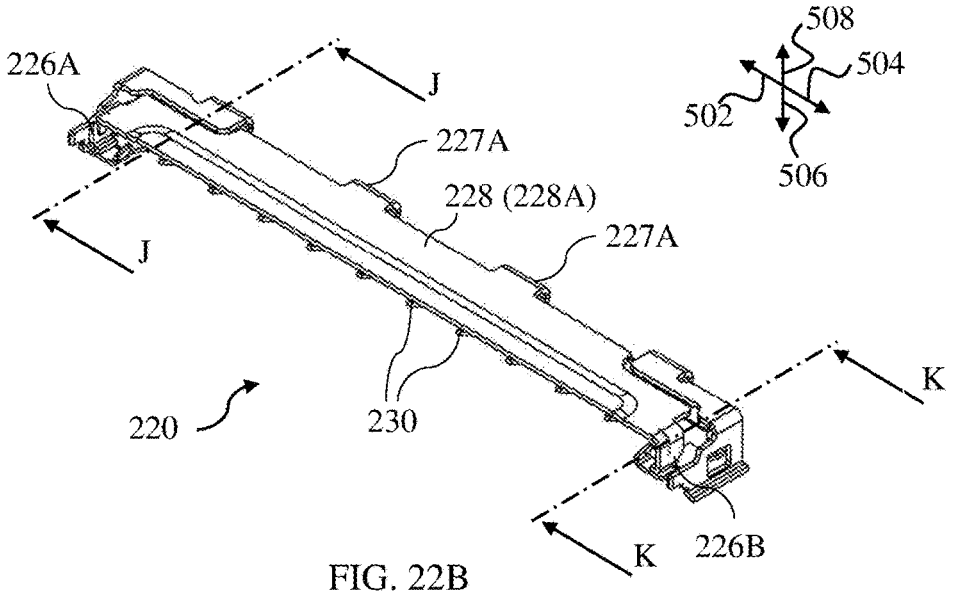
FIG. 22B is a perspective view of an actuating member of the circuit board connector as depicted in FIG. 19.
Figure 22C:
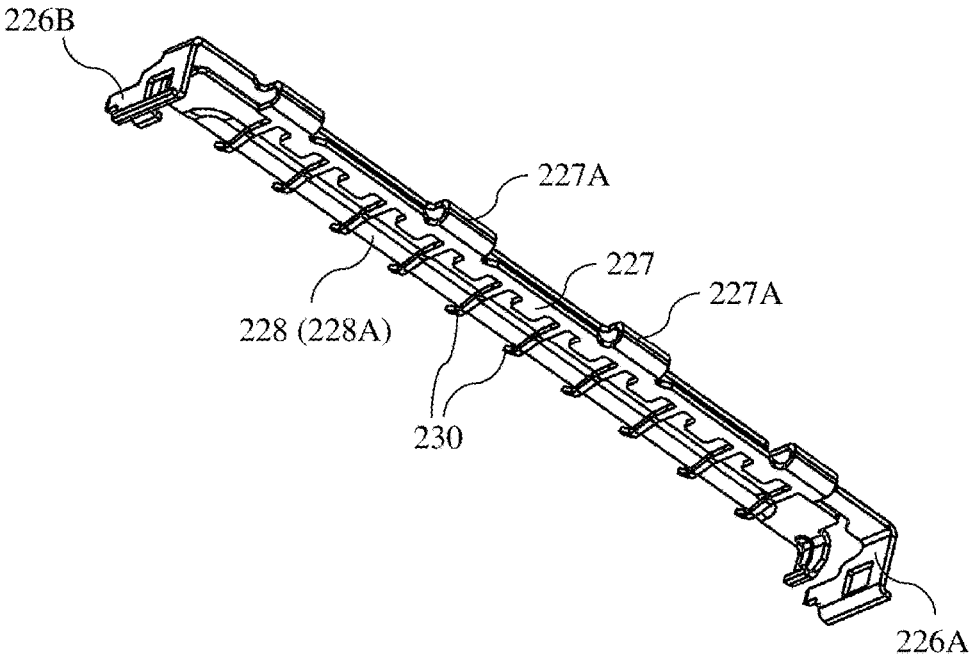
FIG. 22C is a bottom perspective view of an actuating member of the circuit board connector as depicted in FIG. 19.
Figure 23:
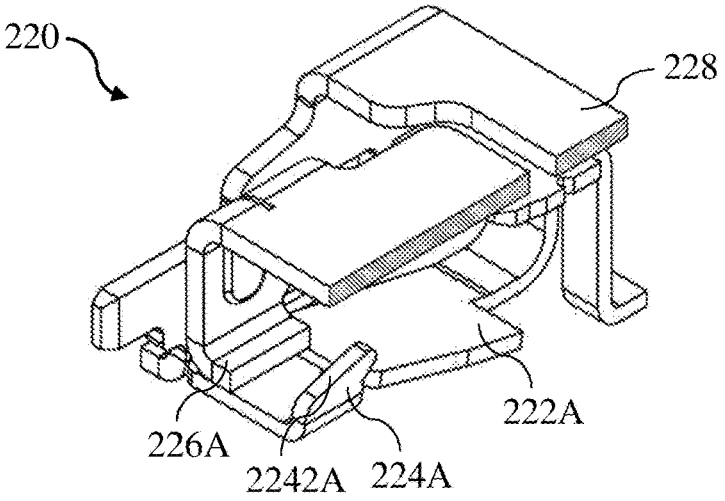
FIG. 23 is a cross section view of the actuating member as depicted in FIG. 22A along line J-J.
Figure 24:
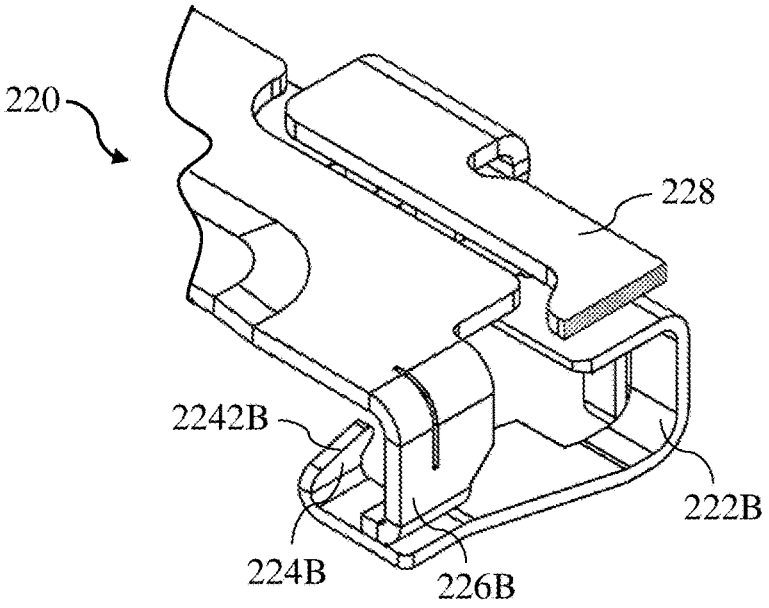
FIG. 24 is a partial cross section view of the actuating member as depicted in FIG. 22A along line K-K.
Figure 25:
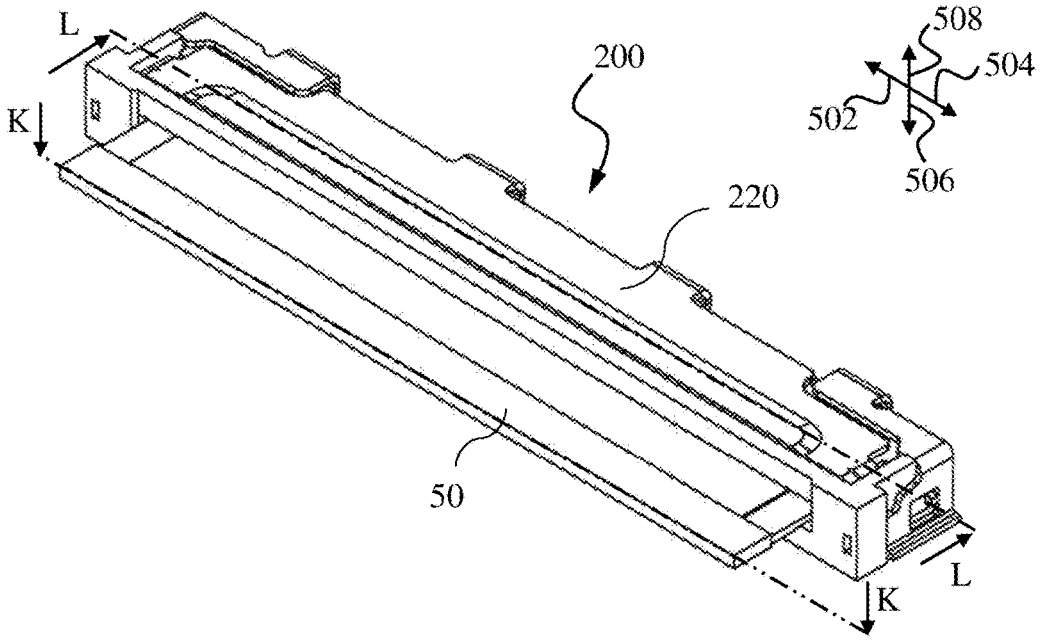
FIG. 25 is a perspective view of the circuit board connector show in FIG. 19 and a circuit board connected to the circuit board connector.

FIGS. 17A, 17B and 17C illustrate a process of connecting a circuit board 50 into the circuit board connector 100' which is similar to that illustrated above in conjunction with FIGS. 10A, 10B and 10C. After circuit board 50 is fully inserted into slot 107, stopper 140 is placed I the space between housing 110 and beam 128, to prevent deflection of actuating arms 126A, 126B toward locking arms 122A. 122B. As such, latches 124A. 124B are prevented from moving out of openings 52, 54 but remain engaged with retaining portion 51 of circuit board 50.

With reference to FIGS. 18A, 18B, 18C and 18D, to disconnect the circuit board 50 from the electrical connector 100', the stopper 140 is firstly pulled along direction 140A away from the space between housing 110 and beam 128 of actuating member 120, to allow the upper portion 128*a* of the beam 128 of the actuating member 120 to move in the downward direction 406, by an external force 410. The subsequence process steps are similar to the process of disconnecting the circuit board 50 from the electrical connector 100 as illustrated above in conjunction with FIGS. 11A, 11B and 11B. After the circuit board 50 is removed from the electrical connector 100', the stopper 140 maybe pushed back along direction 140B and positioned between housing 110 and beam 128 of actuating member 120, for a circuit board to be connected again. In this manner, the stopper 140 provides a secondary lock to avoid undesired removal of a circuit board from the circuit board connector.

In accordance with yet another embodiment, as predicted in FIGS. 19, 20A, 20B and 21, a circuit board connector 200 comprises a housing 210, an actuating member 220 attached to the housing 210, and at least one signal contact 229 disposed in the housing 210. A circuit board 50 is inserted into the circuit board connector 200 from a front side 202 of the housing 210. The circuit board 50 has two openings or notches 52, 54 formed at the lateral sides for engaging with the circuit board connector 200. Actuating member 220 has least one ground terminal 230 extending from the base member 227, toward front side 202 of housing 210. Ground terminal 230 has a contact portion 230A which is disposed at an opposite side of slot 207 with respect to the contact portion 229A of signal contact 229.

As shown in FIGS. 22A, 22B, 23, 24A and 24B. The actuating member 220 has a base member 227, a beam 228 connected to base member 227 through two joint members 227A, and a pair of actuating arms 226A, 226B connected to beam 228. The base member 227 is fixedly attached to the housing 210, and the beam 228 and the pair of actuating arms 226A, 226B are resiliently deformable relative to the base member 227.

Joint members 227A allows resilient deflection of the beam 228 relative to base member 227. The at least one ground terminal 230 extends from the base member 227 and capable of deflecting in the upward direction 508 and downward direction 506 relative to the base member 227. Actuating member 220 may have a pair of side plates 221A. 221B connected to base member 227. The pair of side plates 221A, 221B are fixedly attached to the housing 210, and the beam 228 and the pair of actuating arms 226A. 226B are resiliently deformable relative to the pair of side plates 221A. 221B and base member 227.

Locking arms 222A and 222B are attached to housing 210 and positioned below the actuating arm 226A and 226B, respectively, such that downward movement of the actuating arms 226A and 226B along direction 506 can respectively drive locking arms 222A and 222B to deflect in the downward direction 506 from a lock position to an unlock position. Each of the locking arms 222A and 222B has a latch 224A and 224B projected in an upward direction 508, respectively.

Figure 26:
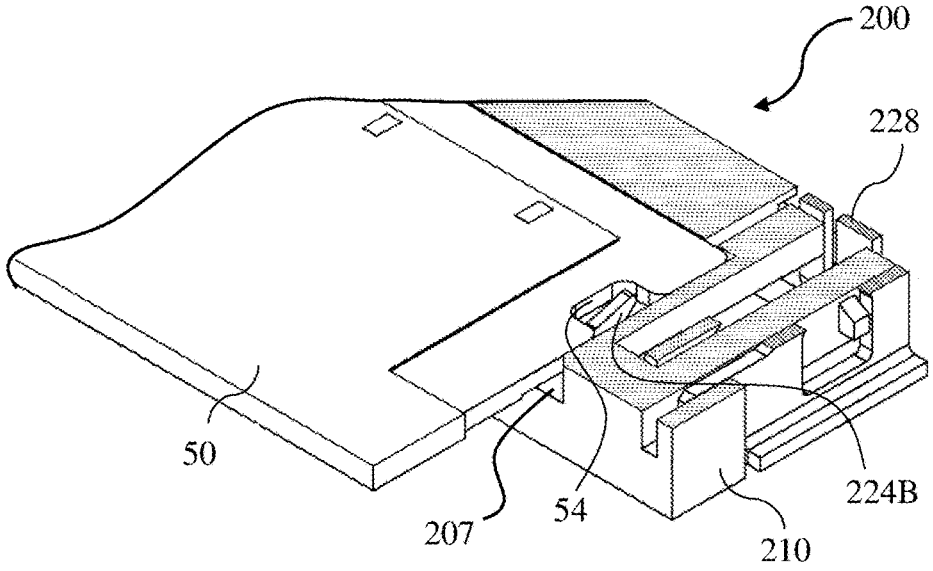
FIG. 26 is an enlarged partial cross section view of the electrical connector as depicted in FIG. 25 along K-K.
Figure 27:
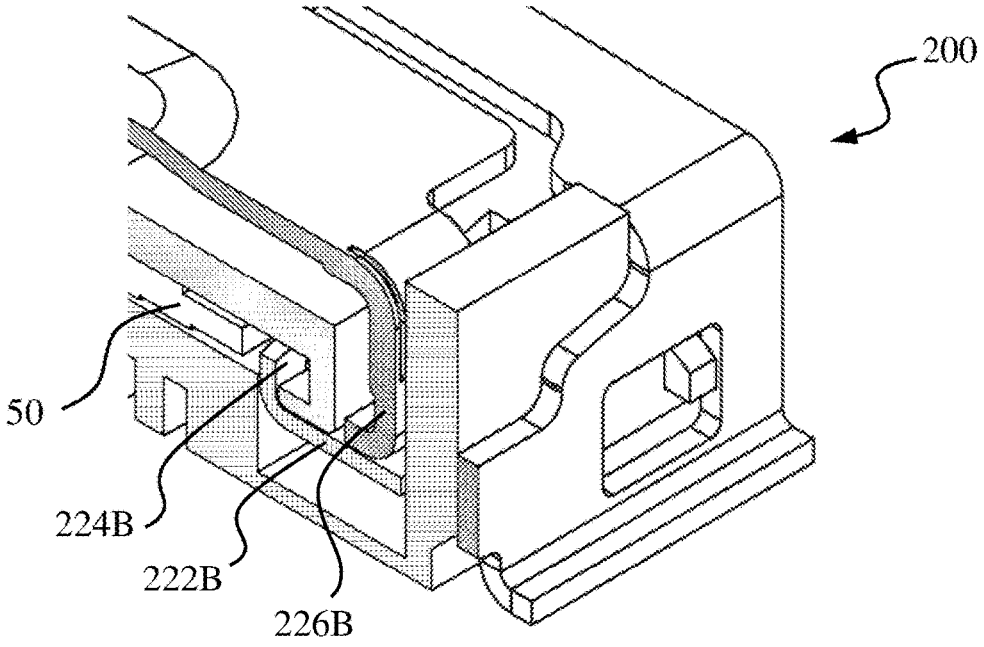
FIG. 27 is an enlarged partial cross section view of the circuit board connector as depicted in FIG. 25 along L-L.

As shown in FIG. 26 and FIG. 27, when circuit board 50 is fully inserted into slot 207, the latch 224B of lock arm 222B is protruded from the opening 54 located at the right direction 504 end of the circuit board 50. Likewise, although not shown in FIG. 26, it is understood that latch 224A of locking arm 222A is protruded from the opening 52 located at the left direction 502 end of the circuit board 50. As such, latches 224A. 224B engage with openings 52 and 54, respectively, to prevent retraction of circuit board 50 from slot 207. The circuit board 50 is thereby locked to the circuit board connector 200 by the locking projections 224A and 224B.

Figure 28A:
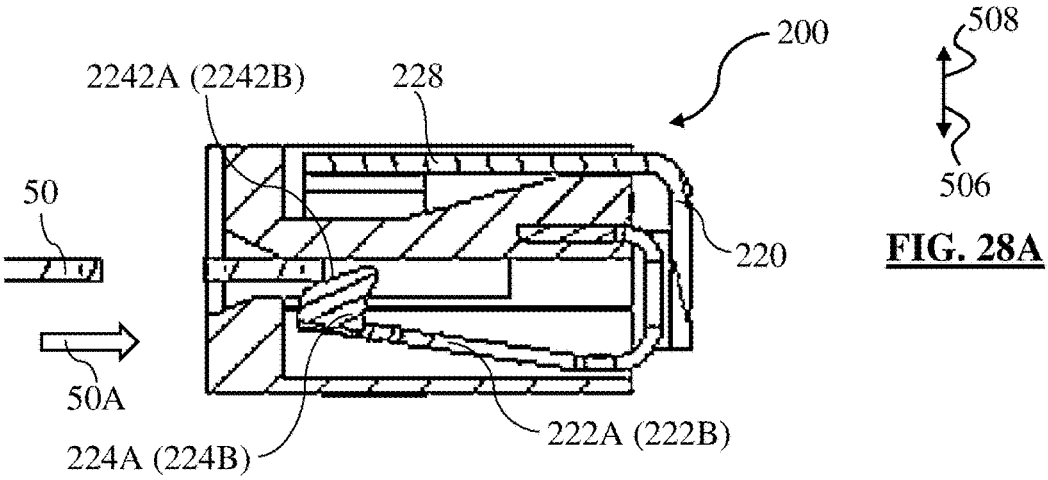
FIGS. 28A, 28B and 28C are cross sectional side views of FIG. 19 along H-H showing the latch in a process of connecting a circuit board to the circuit board connector as depicted in FIG. 19.
Figure 28B:
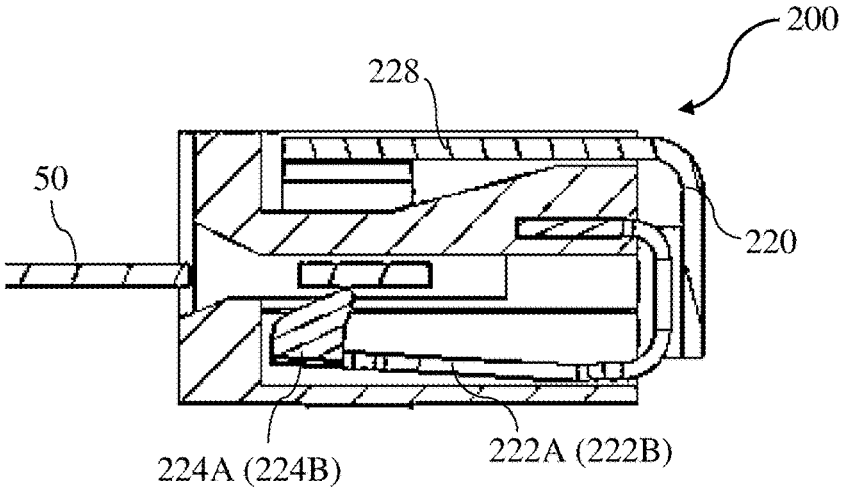
Figure 28C:
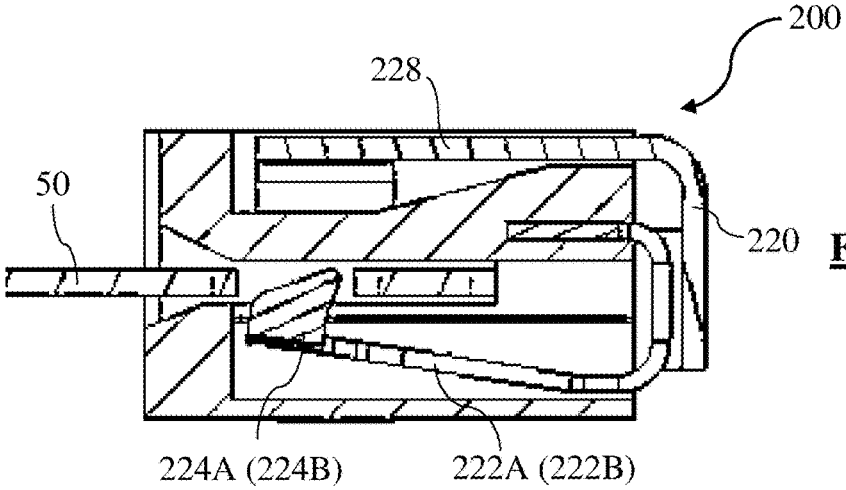

The process of connecting a circuit board 50 to the circuit board connector 200 is illustrated herein in conjunction with FIGS. 28A, 28B and 28C. The circuit board 50 is to be inserted, along direction 50A, into slot 207 of the circuit board connector 200 from a front side 202. The circuit board 50 is then brought into contact with an inclined surface 2242A and 2242B of the latches 224A and 224B which is positioned in front of the insertion path as seen in FIG. 28A. Advancement of circuit board 50 along insertion direction 50A exerts a pressure on the inclined surface 2242A and 2242B of the latches 224A and 224B, by which, the circuit board 50 pushes the locking arms 222A and 222B to deflect in the downward direction 506 from an original position as seen in FIG. 28A to an unlocked position, as seen in FIG. 28B where the locking projection 224A is deflected away from the insertion path of slot 207, to allow the circuit board 50 to pass over. As the circuit board 50 is further inserted into the slot 207, the openings 52 and 54 will become in alignment with the latches 224A, 224B, respectively, hence the latches 224A, 224B are allowed to return to its original (locked) position by the resilience of locking arms 222A and 222B, thereby locking the circuit board 50 to the circuit board connector 200. In this manner, the circuit board 50 is locked to the circuit board connector 200 by the locking projections 224A and 224B and is prevented from being detached from the circuit board connector 200. Electrical connections between the flexible circuit and the electrical connector is established and maintained.

Figure 29A:
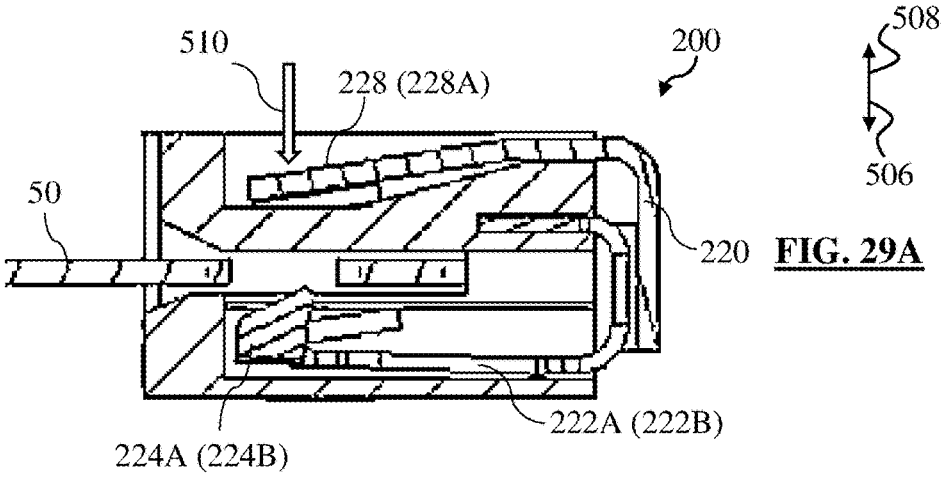
FIGS. 29A, 29B and 29C are cross sectional side views of FIG. 19 along H-H showing the latch in a process of disconnecting a circuit board from the circuit board connector as depicted in FIG. 19.
Figure 29B:
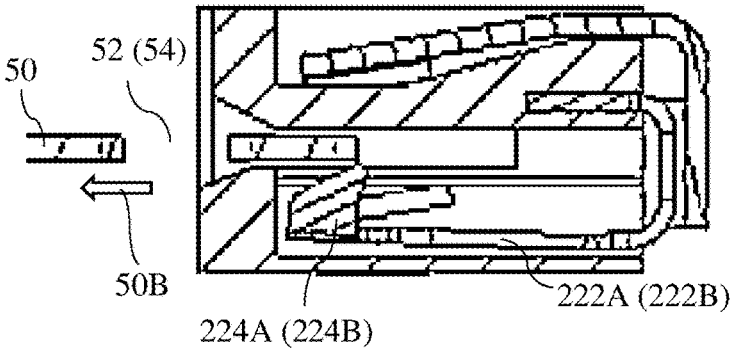
Figure 29C:
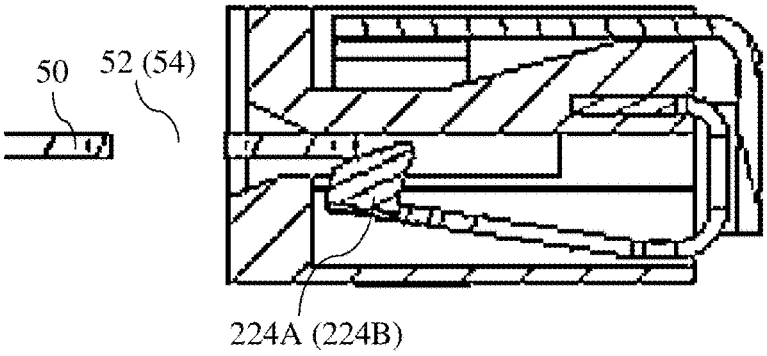
Figure 30A:
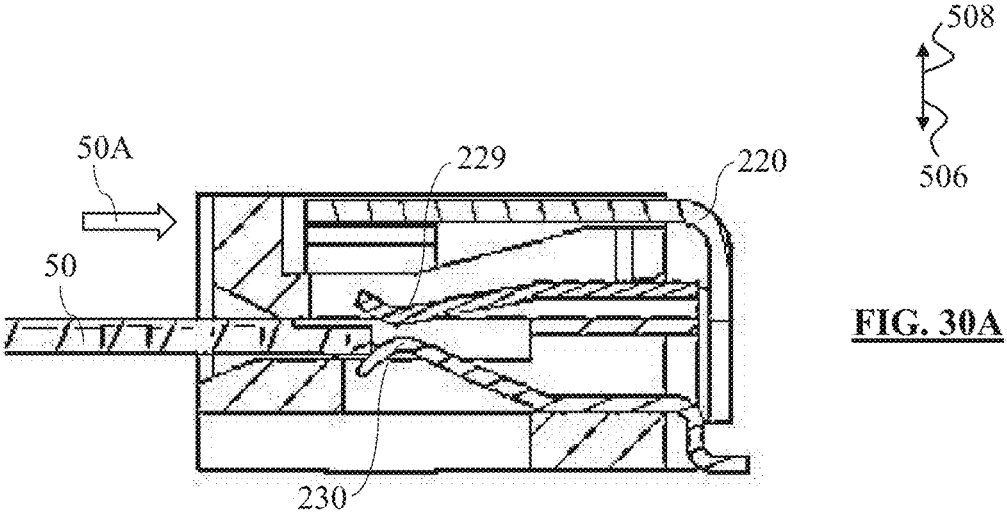
FIGS. 30A and 30B are cross sectional side views of FIG. 19 along H-H showing the signal contact and ground terminal in a process of connecting a circuit board to the circuit board connector as depicted in FIGS. 28A, 28B and 28C.
Figure 30B:
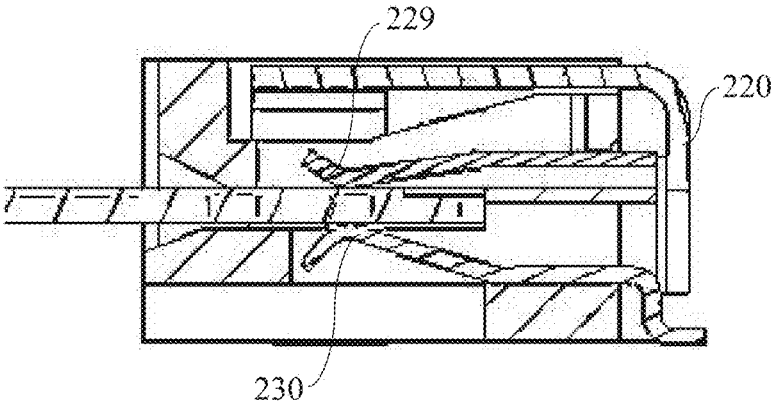

The disconnection process of circuit board 50 from the circuit board connector 200 is illustrated below in conjunction with FIGS. 29A, 29B and 29C. Firstly, the beam 228 of the actuating member 220 is pressed in the downward direction 506 by an external force 510, which simultaneously moves the actuating arms 226A and 226B in the downward direction 506, and the actuating arm 226A in turn drives the latches 222A, 222B to deflect in the downward direction 506, causing the latches 224A and 222B to move out of the openings 52, 54 of the circuit board 50 to the unlocked position as shown in FIG. 29B. The circuit board is then able to be removed from the circuit board connector 200.

Although embodiments of the present invention have been illustrated in conjunction with the accompanying drawings and described in the foregoing detailed description, it should be appreciated that the present invention is not limited to the embodiments disclosed. Therefore, the present invention should be understood to be capable of numerous rearrangements, modifications, alternatives and substitutions without departing from the spirit of the invention as set forth and recited by the following claims.

The invention claimed is:

1. An electrical connector comprising:

a housing having a slot formed therein;

at least one signal contact disposed in the housing;

a pair of locking arms attached to the housing, each locking arm having a latch, the pair of locking arms being resiliently deformable relative to the housing between a lock position at which the latch is positioned to block a clearance in the slot and an unlock position at which the latch is positioned to form the clearance in the slot; and an actuating member coupled to the housing and resiliently deformable relative to the housing between an original position and a deflected position, wherein the actuating member comprises a pair of actuating arms configured such that the latch of each locking arm is allowed to remain at the lock position when the actuating member is at the original position, and when the actuating member is displaced toward the deflected position, an external surface on each of the pair of actuating arms presses against an external surface on each of the pair of locking arms such that the pair of locking arms is moved to the unlock position;

wherein the actuating member further comprises a beam connecting the pair of actuating arms, and the beam is configured to receive an external force to move the actuating member from the original position to the deflected position.

2. The electrical connector as recited in claim 1, wherein the latch of each locking arm comprises an inclined surface facing a front side of the housing, wherein upon the inclined surface being abutted by a retaining portion of a circuit board inserted into the slot, the latch of each locking arm displaces from the lock position to the unlock position to form the clearance, and after the retaining portion passes over the inclined surface, the latch of each locking arm returns from the unlock position to the lock position to block the clearance.

3. The electrical connector as recited in claim 2, wherein after the retaining portion passes over the inclined surface, the latch of each locking arm returns from the unlock position to the lock position to engage the retaining portion to prevent the circuit board from being removed out of the slot.

4. The electrical connector as recited in claim 1, wherein the actuating member further comprises a pair of side plates connected to the beam, the pair of side plates being fixedly attached to the housing, and the beam and the pair of actuating arms being resiliently deformable relative to the pair of side plates.

5. The electrical connector as recited in claim 1, further comprising at least one ground terminal attached to the housing, the at least one ground terminal having a ground contact portion positioned at a bottom side of the slot.

6. The electrical connector as recited in claim 5, wherein the at least one signal terminal further comprises a signal contact portion positioned at the bottom side of the slot.

7. An electrical connector comprising:

a housing having a slot formed therein;

at least one signal contact disposed in the housing;

a pair of locking arms attached to the housing, each locking arm having a latch, the pair of locking arms being resiliently deformable relative to the housing between a lock position at which the latch is positioned to block a clearance in the slot and an unlock position at which the latch is positioned to form a clearance in the slot;

an actuating member coupled to the housing and resiliently deformable relative to the housing between an original position and a deflected position, wherein the actuating member comprises a pair of actuating arms configured such that the latch of each locking arm is allowed to remain at the lock position when the actuating member is at the original position, and when displaced toward the deflected position, the pair of actuating arms bias against the pair of locking arms to move the pair of locking arms to the unlock position; and a stopper movably attached to the housing, wherein upon being positioned in a space between the housing and the actuating member, the stopper prevents the pair of actuating arms from deflecting from the original position to the deflected position and upon removing the stopper from the space, the pair of actuating arms is allowed to deflect from the original position to the deflected position.

8. The electrical connector as recited in claim 7, wherein:

the latch of each locking arm comprises an inclined surface facing a front side of the housing such that inserting a retaining portion of a circuit board into the slot displaces the latch of each locking arm from the lock position to the unlock position to form the clearance, and each locking arm is springy such that, after the retaining portion passes over the inclined surface, the latch of each locking arm returns from the unlock position to the lock position to block the clearance.

9. The electrical connector as recited in claim 8, wherein:

each locking arm comprises a first end and a second end, wherein:

the first end comprises the latch;

the second end is attached to the housing such that each locking arm is attached to the housing in a cantilevered configuration and after the retaining portion passes over the inclined surface, the cantilevered configuration of the locking arm causes the latch of each locking arm to return from the unlock position to the lock position to engage the retaining portion to prevent the circuit board from being removed out of the slot.

10. The electrical connector as recited in claim 7, wherein the actuating member further comprises a beam connecting the pair of actuating arms, wherein the beam is configured to receive an external force to move the pair of actuating arms so as to push the pair of locking arms to the unlock position.

11. The electrical connector as recited in claim 10, wherein the actuating member further comprises a pair of side plates connected to the beam, the pair of side plates being fixedly attached to the housing, and the beam and the pair of actuating arms being resiliently deformable relative to the pair of side plates.

12. The electrical connector as recited in claim 7, further comprising at least one ground terminal attached to the housing, the at least one ground terminal having a ground contact portion positioned at a bottom side of the slot.

13. The electrical connector as recited in claim 12, wherein the at least one signal terminal further comprises a signal contact portion positioned at the bottom side of the slot.

14. An electrical connector comprising:

a housing having a slot formed therein;

at least one signal contact disposed in the housing;

a pair of locking arms attached to the housing, each locking arm having a latch, the pair of locking arms being resiliently deformable relative to the housing between a lock position at which the latch is positioned to block a clearance in the slot and an unlock position at which the latch is positioned to form a clearance in the slot; and an actuating member coupled to the housing, the actuating member comprising:

a beam, wherein the beam is configured to receive an external force to displace the beam from an original position to a deflected position;

a pair of actuating arms connected to the beam, wherein the latch of each locking arm is allowed to remain at the lock position when the beam is at the original position, and when the beam is displaced toward the deflected position, the pair of actuating arms bias against the pair of locking arms to move the pair of locking arms to the unlock position; and a base member connected to the beam, the base member being fixedly attached to the housing, and the beam and the pair of actuating arms being resiliently deformable relative to the base member such that the beam is resiliently deformable relative to the housing between the original position and the deflected position.

15. The electrical connector as recited in claim 14, wherein the actuating member further comprises at least one ground terminal projecting from the base member and disposed in the housing.

16. The electrical connector as recited in claim 15, wherein the at least one ground terminal further comprises a ground contact portion positioned at a top side of the slot, and the at least one signal terminal further comprises a signal contact portion positioned at a bottom side of the slot.

17. The electrical connector as recited in claim 14, wherein the actuating member further comprises a pair of side plates connected to the base member and fixedly attached to the housing.

18. The electrical connector as recited in claim 14, wherein the latch of each locking arm comprises an inclined surface facing a front side of the housing, wherein upon the inclined surface being abutted by a retaining portion of a circuit board inserted into the slot, the latch of each locking arm displaces from the lock position to the unlock position to form the clearance, and after the retaining portion passes over the inclined surface, the latch of each locking arm returns from the unlock position to the lock position to block the clearance.

19. The electrical connector as recited in claim 18, wherein after the retaining portion passes over the inclined surface, the latch of each locking arm returns from the unlock position to the lock position to engage the retaining portion to prevent the circuit board from being removed out of the slot.

20. An electrical connector comprising:

a housing having a slot formed therein;

at least one signal contact disposed in the housing;

a pair of locking arms, wherein each locking arm has a first end and a second end with a latch at the first end, and the second end is attached to the housing at a first position such that the pair of locking arms are resiliently deformable relative to the housing between a lock position at which the latch is positioned to block a clearance in the slot and an unlock position at which the latch is positioned to form the clearance in the slot; and an actuating member coupled to the housing at a second position and resiliently deformable relative to the housing between an original position and a deflected position, wherein the actuating member comprises a pair of actuating arms configured to bias against the locking arms when the actuating member is displaced toward the deflected position, wherein the second position is distinct from the first position; and the actuating member is comprised of metal.

* * * * *